US005785133A

United States Patent [19]

Murray et al.

[11] Patent Number: 5,785,133

[45] Date of Patent: Jul. 28, 1998

[54] MULTIPLE LATERAL HYDROCARBON RECOVERY SYSTEM AND METHOD

[75] Inventors: Mark J. Murray, Sugar Land; Britt O. Braddick, Houston, both of Tex.

[73] Assignee: TIW Corporation, Houston, Tex.

[21] Appl. No.: 520,579

[22] Filed: Aug. 29, 1995

[51] Int. Cl.[6] ..... E21B 7/08

[52] U.S. Cl. ..... 175/61; 175/82; 175/117.5

[58] Field of Search ..... 175/61, 62, 80, 175/81, 82; 166/117.5, 117.6, 50, 313

[56] References Cited

U.S. PATENT DOCUMENTS

| | | | |
|---|---|---|---|
| 2,105,722 | 1/1938 | Barrett et al. | 175/82 X |
| 2,207,920 | 7/1940 | Hughes | 175/81 |
| 2,397,070 | 3/1946 | Zublin . | |
| 2,452,920 | 11/1948 | Gilbert . | |
| 2,797,893 | 7/1957 | McCune et al. . | |
| 4,396,075 | 8/1983 | Wood et al. . | |
| 4,402,551 | 9/1983 | Wood et al. . | |
| 4,415,205 | 11/1983 | Rehm et al. | 166/117.5 X |
| 4,436,165 | 3/1984 | Emery . | |
| 4,444,276 | 4/1984 | Peterson, Jr. . | |
| 4,573,541 | 3/1986 | Josse et al. . | |
| 4,807,704 | 2/1989 | Hsu et al. . | |
| 5,113,938 | 5/1992 | Clayton . | |
| 5,115,872 | 5/1992 | Brunet et al. . | |
| 5,322,127 | 6/1994 | McNair et al. . | |
| 5,332,049 | 7/1994 | Tew . | |
| 5,353,876 | 10/1994 | Curington et al. . | |
| 5,458,209 | 10/1995 | Hayes et al. | 175/61 |
| 5,474,126 | 12/1995 | Lynde et al. | 175/61 X |

*Primary Examiner*—William P. Neuder
*Attorney, Agent, or Firm*—Browning Bushman

[57] ABSTRACT

An assembly for drilling multiple laterals (26) from a borehole and into a formation includes a whipstock assembly having a radially movable lug (82). An elongate tubular secured within the borehole has one or more non-ferrous portions (30) and a ferrous portion (52) adjacent and below a respective non-ferrous portion. A locator (54) is fixed within each ferrous portion at a desired axial spacing relative to the non-ferrous portion. According to the method of the invention, the whipstock assembly is lowered below the locator (54) and pulled upwardly to rotate the whipstock assembly to a selected azimuth within the tubular. The lug (82) on the whipstock assembly fits within the locator to axially position the whipstock face (97) within the non-ferrous portion of the tubular. A drill bit (96) engages the whipstock face and drills a window through the non-ferrous portion of the tubular and then into the formation.

48 Claims, 12 Drawing Sheets

46
41
52A
54A
30A
46
44
45
42
70
74
72
76
68
75

62
58
46
52B
54B
30B

MULTIPLE LATERAL HYDROCARBON RECOVERY SYSTEM AND METHOD

FIELD OF THE INVENTION

The present invention relates to systems and techniques for more efficiently drilling laterals off a borehole in order to recover hydrocarbons. More particularly, this invention relates to downhole equipment which provides a comparatively low cost technique for drilling multiple laterals through either an inclined or horizontal composite joint casing within a borehole.

BACKGROUND OF THE INVENTION

Those skilled in hydrocarbon recovery operations have long recognized the benefits of drilling multiple laterals off a single borehole extending to the surface. In many applications, the portion of the borehole from which the laterals extend is vertical or inclined, so that each of the laterals may extend into a different level production zone. Several relatively thin production zones may thus be laterally drilled and hydrocarbon recovered from each production zone with only one borehole extending to the surface. In recent years, boreholes extending to the surface have been drilled with lower portions extending substantially horizontally through an oil bearing formation. Multiple horizontally extending laterals off this horizontal portion of the borehole allow for more efficient recovery of hydrocarbons from the zone.

The use of coiled tubing and downhole mud motors below coiled tubing for horizontal drilling operations present significant challenges to the industry because of the inability of coiled tubing to be rotated, or to support or sustain compressive loading. Nevertheless, coiled tubing is often used in such applications to more easily pass through the bend frequently required for horizontal drilling and to reduce the time required for trips in and out of the hole. The use of coiled tubing and downhole mud motors below coiled tubing thus significantly reduces the cost of the drilling operation.

In prior art applications, laterals extending from an inclined borehole are typically drilled by first milling a window through the casing with a series of mills guided by a whipstock. The window in the side of the casing is typically completed using several mills, each requiring one or more trips in and out of the well. After the window cutting mills are retrieved to the surface, conventional bits are thereafter used to drill into the formation of interest. The same procedure has been used for drilling laterals off a horizontal portion of a borehole, although difficulties are frequently encountered when utilizing a whipstock to mill or open a window at a radial position in the casing which is at a substantial angle from the casing's high side. In a lateral drilling operation of a horizontal portion of a wellbore, the whipstock will naturally lay against the side of the borehole opposite the direction the lateral is to be drilled only when the window to be opened is substantially opposite the casing's low side. Accordingly, when opening a window at a location circumferentially spaced from the casing's high side, the whipstock must be retained in a position so that the whipstock face is properly oriented with respect to the horizontal lateral to be drilled.

While the above techniques have been used with some success to form laterals off both inclined and horizontal boreholes, numerous problems and lateral drilling failures occur. Improved equipment and techniques are required to further reduce the cost of such lateral drilling operations. High costs are frequently incurred when drilled through the metal casing with conventional state of the art window milling tools, requiring tripping in and out of the hole to open and dress the window before commencing to drill the lateral. Also, significant costs are associated with locating and orienting the whipstock each time it is run in the hole to drill a new lateral.

U.S. Pat. No. 5,332,049 discloses a drill pipe joint formed from a fiber reinforced synthetic tube. Metal fittings are used at the ends of the tube for threadably connecting drill pipes together. The synthetic tube has high flexibility for use in deviated boreholes.

U.S. Pat. No. 5,353,876 discloses a technique for drilling laterals from a tubular in a wellbore. A whipstock packer assembly is positioned in the tubular for directing a bit to drill a window through the tubular. A guide is disclosed for sealing between the tubular in the primary borehole and the liner in the lateral.

The disadvantages of the prior art are overcome by the present invention, and improved equipment and techniques are hereinafter disclosed for drilling multiple laterals off a borehole in a more cost effective manner. The techniques of the present invention may be used to drill laterals off a vertical, inclined, or horizontal borehole. Either conventional rotary drill strings or a coiled tubing string utilizing a downhole mud motor may be reliably used to rotate the bit, thereby further reducing drilling time and expense. The present invention is particularly well suited for drilling laterals with a mud motor located at the end of a coiled tubing string.

SUMMARY OF THE INVENTION

A preferred embodiment of the invention utilizes a composite material tubular which is run into that portion of the borehole where laterals will subsequently be drilled. The conventional steel portion of the tubular is provided for strength and reduced costs. A comparatively soft material portion of the tubular, which may be formed from fiberglass, is provided to facilitate opening a window through the tubular for drilling of the lateral. A coiled tubing mud motor may be used to power a PDC bit, which engages a whipstock face to cut through the fiberglass material tubular. The PDC bit may continue drilling the lateral into the formation of interest. Change out from a window mill to a PDC bit is not required, thereby significantly reducing drilling time and expense.

The steel portion of the downhole tubular is provided with multiple locator profiles for cooperation with an improved retrievable whipstock assembly. The whipstock face may be desirably oriented with respect to a locator profile for drilling of the lateral based on the azimuth or radial location of the profile previously determined with an orientation tool. A spring loaded locator lug on a locator tool engages a profile in the downhole tubular to reliably locate and releasably anchor the whipstock assembly. The whipstock assembly includes a wedge mechanism to ensure that the back of the whipstock is positioned against the tubular at the location radially opposite the face of the whipstock. An internal latch prevents premature setting of the wedge mechanism while running the tool in the well. The whipstock assembly, including a lower locator tool and an upper whipstock body with a whipstock face for engaging the bit, is positionable within the tubular and retrievable to the surface with a novel whipstock retrieval tool.

Each locator profile in the tubulars may thus be positioned for drilling each of the multiple laterals. After drilling one lateral from a composite tubular, the whipstock assembly may be moved upward to a new location. Assuming laterals are drilled in the same direction, re-orientation of the whipstock may not be required. It is thus possible to drill multiple laterals without retrieving the whipstock to the surface. The whipstock may include a bored internal diameter for running and retrieving operations.

According to the method of the present invention, a lowermost lateral (or the lateral in a horizontal well which is farthest from the surface) may first be drilled. The whipstock is oriented at the surface after running a locator tool and an orientation or directional survey tool into the well for determining the radial location of the locator profile within each composite tubular. The whipstock assembly is run into the well and the locator lug fits within the lowermost profile in the tubular to locate and orient the whipstock face as the whipstock assembly is pulled upward in the well. The configuration of the profile and the locator lug prevent downward movement of the whipstock. Once the whipstock assembly is secured within the tubular, the running tool is disengaged from the whipstock assembly and removed from the well, and a PDC bit is run into the well and engages the whipstock, which easily directs the bit to drill through the fiberglass tubular and into the formation of interest. A special bit to drill a window in the tubular is accordingly not required. The bit is removed from the well and the running/retrieving tool is used to re-engage the whipstock assembly. Upward pull on a coiled tubing string may then release the whipstock from this lowermost profile. The whipstock may be moved upward along the wellbore until it locks into a profile of a second tubular member. Alternatively, the whipstock may be retrieved to the surface after drilling the first lateral, and may subsequently be re-oriented and lowered below the second profile, then pulled upwardly to lock in position on the second profile. The whipstock retrieving tool engages a restriction sleeve in the bore of the whipstock, and may continually pass washing fluids below the retrieving tool as it is positioned and latched to the whipstock.

An object of this invention is to provide an improved, relatively low cost system for drilling multiple laterals off a borehole. The downhole tubular includes multiple locator profiles each for cooperating with a locking mechanism on a whipstock, thereby substantially reducing the cost associated with locating and orienting the whipstock. A locator profile in the downhole tubular is accordingly used to orient the whipstock for efficient drilling of a lateral through the tubular and into the formation.

It is another object of this invention to provide a technique for drilling laterals off a borehole, whereby a bit may drill through a non-ferrous portion of a composite material tubular, then continue drilling into the formation of interest. The multiple locator profiles are each provided on a ferrous portion of the tubular spaced adjacent and below the non-ferrous portion of the tubular. A related object of the invention includes a method of drilling a lateral, wherein a whipstock is located and oriented relative to a profile in a metal portion of the downhole tubular so that the whipstock face is within a portion of the non-ferrous tubular in which a window may be cut with a PDC bit. A significant savings in drilling time and expense is achieved by drilling through the non-ferrous tubular and continuing to drill into the formation of interest with the same bit.

It is a feature of this invention that improved techniques are provided for forcing the surface of the whipstock radially opposite the whipstock face into engagement with the tubular opposite the window to be opened. A wedge mechanism may be provided between the whipstock face and the locator tool, and presses the whipstock into engagement with the tubular. The tubular is preferably formed from a composite material in the area where the laterals are drilled, with the relatively soft material section of the tubular facilitating cutting of the window and the relatively hard material section of the tubular providing longitudinal and anti-rotational support for the whipstock. The tubular may be formed from fiberglass in the area where the window will be cut in the tubular, and from steel in the area providing support for the whipstock.

It is also a feature of the invention that the whipstock is positioned below a locator profile in the tubular, so that the whipstock assembly is pulled upward to engage the downhole profile with the locator lug. The locator lug and profile cooperate to prevent inadvertent downward movement of the whipstock, and resist rotation of the whipstock assembly due to torque developed in the drilling out process. The locator lug and profile also allow the whipstock to be released from a profile with a subsequent upward pull on the whipstock. Another feature of the invention is that the locator profiles provide a technique whereby the whipstock may be oriented only once while being used to drill multiple laterals from a borehole. The whipstock may remain downhole while multiple laterals are drilled, or may be retrieved to the surface after each lateral is drilled.

Yet another feature of the invention is a reliable whipstock retrieving tool for positioning the whipstock assembly within the tubulars and for retrieving the whipstock assembly to the surface. The retrieving tool includes a collet assembly for engaging a restriction sleeve within the bore of the whipstock. Fluid may be continually pumped through and below the retrieving tool to wash debris which might otherwise prevent connection of the tool with the whipstock.

A significant advantage of this invention is that laterals may be easily drilled through a tubular and into a formation of interest using a drill motor suspended in the tubular from a coiled tubing string. Another significant advantage of the invention is the savings reduced by not using a series of bits to cut a window through a downhole tubular, and another bit to drill a lateral into the formation from the window. Yet another advantage of the invention relates to the versatility of the whipstock assembly, which includes an internal bore for facilitating various running and retrieving operations.

These and further objects, features, and advantages of the present invention will become apparent from the following detailed description, wherein reference is made to the figures in the accompanying drawings.

BRIEF DESCRIPTION OF THE PREFERRED EMBODIMENTS

FIGS. 1–4 depict various configurations of a borehole with drilled laterals according to the present invention. The boreholes and laterals depicted in these figures are simplistically shown to illustrate different embodiments of the present invention. Details with respect to the components used to achieve the effective drilling of the laterals is provided in the remaining figures. The borehole may be used for the efficient recovery of hydrocarbons, although the concepts of the present invention could be used for the recovery of other fluids, such as geothermal fluids or for injection of fluids into a subsurface formation.

Figure 1:
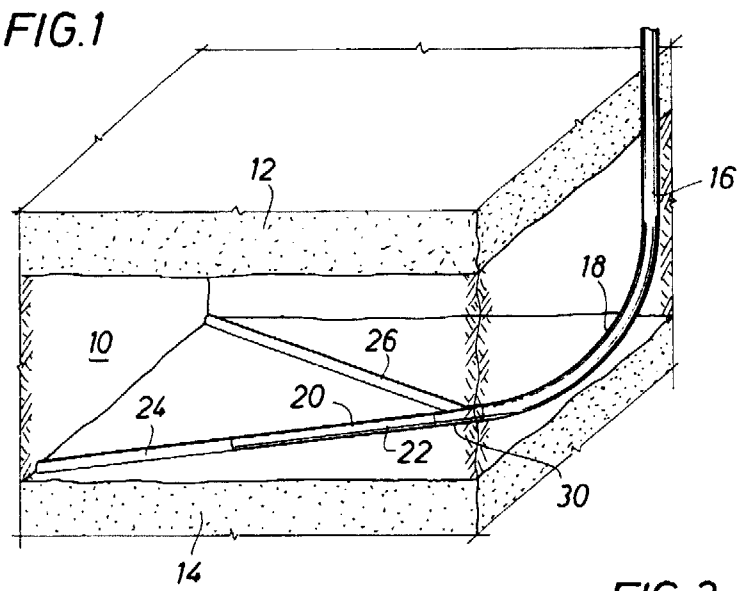
FIG. 1 is a simplified view of one embodiment according to the present invention, wherein a single substantially horizontal lateral is drilled off a substantially horizontal portion of a wellbore.

FIG. 1 depicts a substantially vertical borehole 16 which includes a bend 18 so as to position a horizontally extending portion 20 of the borehole (also referred to as a horizontal borehole) within the lower portion of zone or formation 10. For purposes of discussion, zone 10 may be considered an oil bearing formation of interest sandwiched between upper formation 12 and lower formation 14. A tubular, such as casing 22, may be positioned within the vertical borehole 16 and at least a portion of the horizontal borehole 20. If desired, a portion 24 of the drilled horizontal borehole may be uncased or open hole.

The present invention utilizes a composite tubular within at least a portion of the cased borehole. The composite tubular includes a relatively soft material portion, which may be formed from fiberglass, and a conventional steel portion adjacent each end of the soft material portion. Further details with respect to a composite tubular are discussed below. For illustration purposes, FIGS. 1–4 depict a fiberglass portion of the tubular at each location wherein a lateral is extending from the primary borehole. FIG. 1 accordingly depicts fiberglass tubular section 30 within the horizontal portion of the borehole. Drilled lateral 26 extends outwardly from the borehole 20 and is preferably within substantially the same horizontal plane which contains borehole 20 in the lower portion of formation 10, thereby forming a single Y lateral. Each of borehole 20 and the lateral 26 may thus be used for the recovery of oil from the formation to the surface, thereby increasing the production efficiency from the well.

Figure 2:
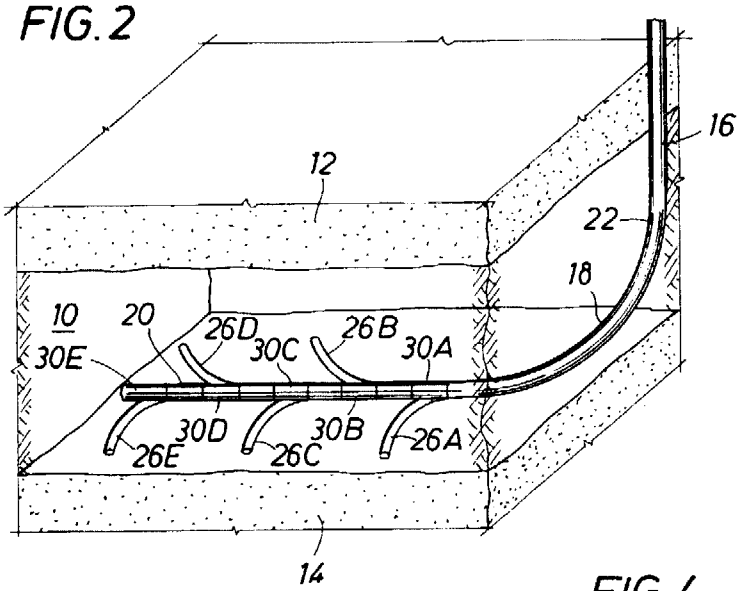
FIG. 2 a simplified view of another embodiment of the invention, wherein multiple horizontal laterals are each drilled off a horizontal portion of a wellbore.

FIG. 2 depicts a similar borehole with casing 22 therein. In the FIG. 2 embodiment, numerous lateral 26A, 26B, 26C, 26D and 26E each extend from a respective fiberglass tubular section 30A, 30B, 30C, 30D and 30E. A conventional metal casing or similar metal tubular is used in the axial spacing between the fiberglass sections, as shown. The FIG. 2 embodiment thus has several laterals extending in one direction and other laterals extending in a radially opposing direction from the horizontal portion of the borehole. Each of the laterals may, however, lie substantially within the same horizontal plane within the lower portion of zone 10, thereby enhancing the recovery of oil from the formation 10. Those skilled in the art will appreciate that each of the laterals as shown in FIG. 2 may extend a desired distance from the horizontal portion of the borehole, and only short portions of the laterals are depicted in FIG. 2 for simplicity.

Figure 3:
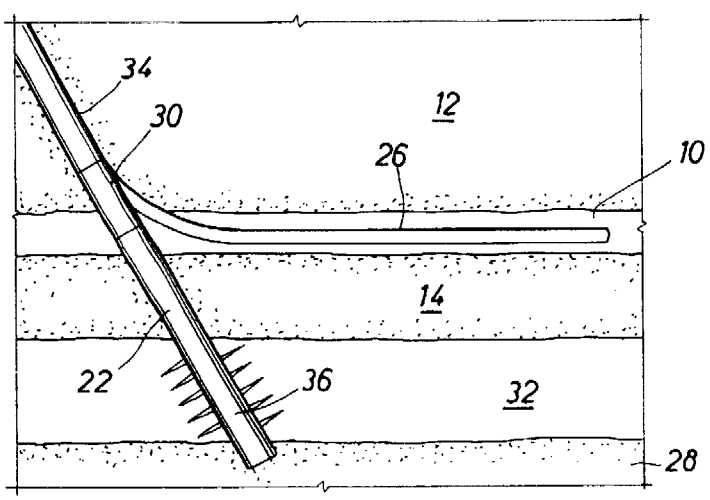
FIG. 3 illustrates another embodiment of the invention, wherein the lateral is drilled off an inclined borehole and into an upper production zone after a lower production zone has been perforated.

FIG. 3 depicts inclined borehole 34 with casing 22 therein. Casing 22 may be installed with fiberglass section 30 adjacent thin production zone 10. The lower end of the casing 22 may extend into a relatively thick production zone 32 spaced between zones 14 and 28. Hydrocarbons may be initially recovered from zone 32 by perforating the casing 22 at location 36. Thereafter, a lateral 26 may be drilled according to the present invention through the tubular section 30 and into the relatively thin zone 10. Accordingly, hydrocarbons may be recovered from zone 10 after zone 32 has been substantially depleted.

Figure 4:
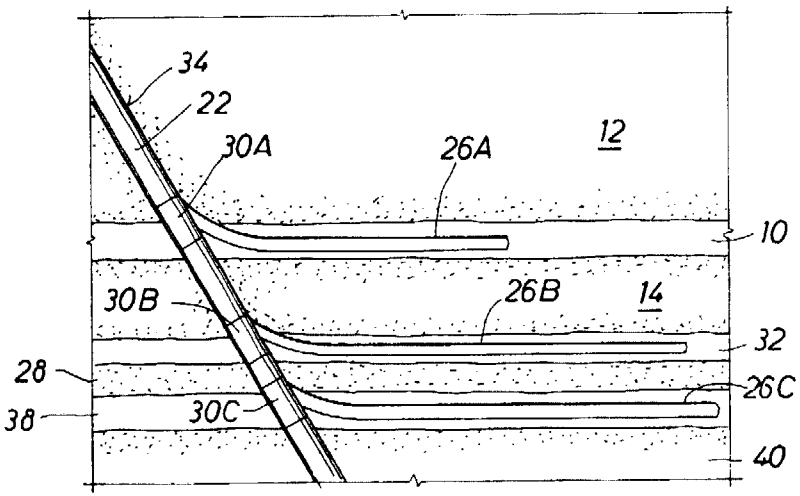
FIG. 4 illustrates yet another embodiment of the invention, wherein multiple laterals are drilled off an inclined borehole, with each lateral extending into a respective relatively thin formation of interest.

FIG. 4 depicts the similarly inclined borehole 34 with fiberglass sections 30A, 30B and 30C axially spaced along the length of casing 22. According to the present invention, a metal tubular member may be used between the fiberglass tubular sections, as explained subsequently. For the FIG. 4 embodiment, multiple laterals 26A, 26B, and 26C may thus be drilled into the relatively thin production zones 10, 32, and 38, respectively. Each lateral is drilled through a respective fiberglass section as indicated. The borehole 34 may continue downward past zone 38 into formation 40. If desired, the borehole 34 may include a bend at the lower end of the borehole and a horizontal borehole lying within the lower portion of another formation of interest, as shown in FIGS. 1 and 2.

Each of the laterals shown in FIG. 4 is drilled through the "top side" or "high side" of the tubular. Drilling a lateral through the high side of a tubular in an inclined or horizontal borehole is conventional, since the whipstock naturally rests against the low side of the tubular. Although not depicted in FIG. 4, it is a feature of the present invention for one or more laterals to be drilled through a low side of a tubular fiberglass section, so that a lateral may extend to the left of borehole 34 shown in FIG. 4, while other laterals extend to the right of the same borehole. Similarly, laterals may be drilled through the side of the fiberglass tubular section, so that laterals may extend in a direction substantially 90° from the laterals depicted in FIG. 4. Equipment for accomplishing this task is shown in FIGS. 24–27 and is discussed in detail below.

A tubular (not shown) may be fitted within each of the laterals as shown in FIGS. 1–4. A work string may be provided within a casing and extend into any one of the depicted laterals. Also, coiled tubing or conventional tubing sections with threaded ends may be fitted within each lateral and sealed to the casing. It is also possible for some applications that the drilled laterals will remain open hole. In an exemplary embodiment of this invention, the composite tubular may have 4" nominal bore, each drilled lateral may have a 3¾" nominal bore, and a 2⅞" OD tubing liner may be inserted in each lateral.

Figure 5A:
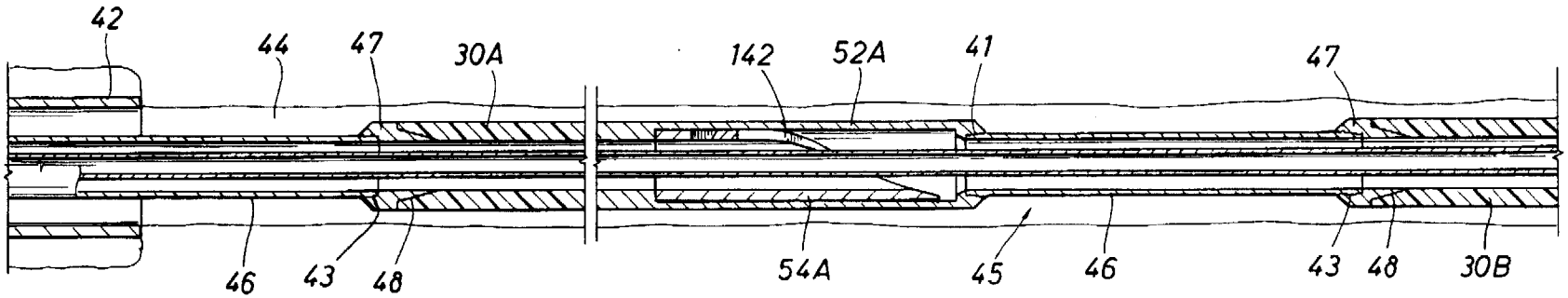
FIGS. 5A and 5B is a partial half section drawing illustrating a composite tubular liner according to the present invention with washdown capability at the lower end of the tubular liner.
Figure 5B:
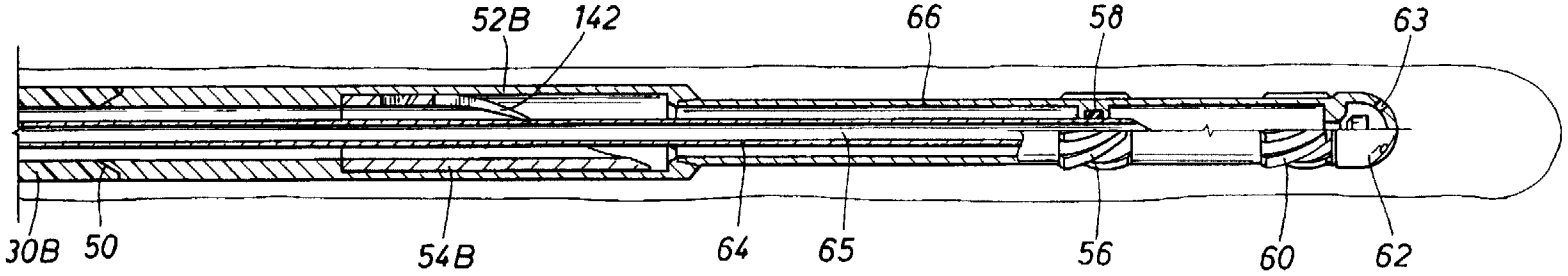

FIGS. 5A and 5B depict one embodiment of the composite tubular according to the present invention. The liner 45 containing the composite tubular 30 extends downhole past a larger diameter casing 42 and into drilled borehole 44. The composite tubular as shown in these figures may be considered a production liner, but is generally referred to herein as tubular 30 since suspension of the tubular from a larger diameter casing is only one technique for fixing the tubular within a wellbore. A conventional tubular or casing section 46 is threadedly connected at 43 to a large diameter metal bushing 47. The lower end of bushing 47 is connected at threads 48 with the relatively soft material tubular section 30A. Similar threads may interconnect the lower end of tubular section 30A with the metal locator profile sub 52A, which is in turn threadedly connected at 41 to a conventional tubing or liner 46. Threads 50 shown in FIG. 5B interconnecting the relatively soft material tubular sections 30B with the locator profile sub 52B are similarly employed for interconnecting the tubular section 30A as shown in FIG. 5A with sub 52A. Metal locator profile subs 52A and 52B of the composite tubular positioned directly beneath the respective fiberglass section 30A and 30B may have a diameter greater that conventional tubular sections 46 which provide the desired spacing between the fiberglass sections. These metal portions 52A and 52B preferably have a diameter greater than sections 46, and may have a diameter approximating that of the fiberglass sections, as depicted.

The locator profile sub 52A includes a locator sleeve 54A fixed therein. A similar locator sleeve 54B is provided within locator profile sub 52B. Each locator sleeve has an orienting edge surface 142 which terminates at its upper end into a slot, as discussed subsequently, for positioning a lug into the slot. The diameter of metal locator profile sub sections 52A and 52B are accordingly such that a substantially uniform bore through the composite tubular is maintained.

Figure 5C:
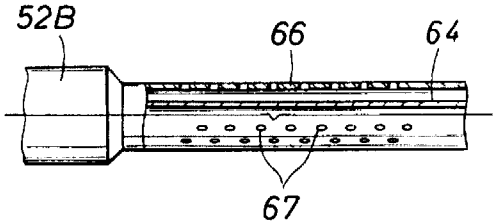
FIG. 5C illustrates an alternative embodiment of a portion of the tubular shown FIGS. 5A and 5B.

Washdown capability may be provided for liner installations, and includes a centralizer 56 with a packoff bushing 58 for guiding sealed tubing string 64 which passes through the composite joint on occasions when perforated casing joints 66 are employed in the liner 45. A washing fluid may thus be pumped into the bore 65 of the work string tail pipe 64 and may exit washing jet nozzle 63 in guide shoe 62 provided immediately below a lower (optional) centralizer 60. As shown in FIG. 5C, perforations 67 in casing joint 66 allow hydrocarbons to be recovered through the liner 45 in applications in which the perforated casing joint 66 is uncemented in the well bore 44 after insertion of the liner 45. The invention thus contemplates that the borehole 44 may be washed with a fluid to remove debris from the interior of the borehole as the composite tubular is positioned within the well. The tail pipe 64 as disclosed herein may also be used to pump cement into the wellbore to cement the composite tubular in place under conditions when no perforated casing joint is employed. Washdown and cementing tools similar to that shown in FIGS. 5B and 5C are well known to those skilled in the art.

Figure 6A:
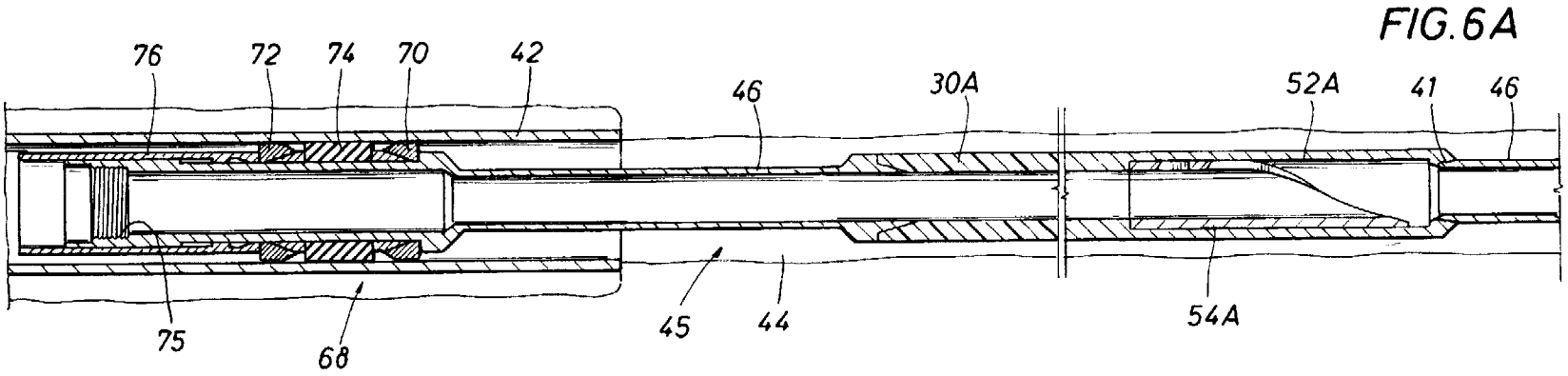
FIGS. 6A and 6B illustrate a composite tubular liner according to the present invention suspended in the wellbore from a casing.
Figure 6B:
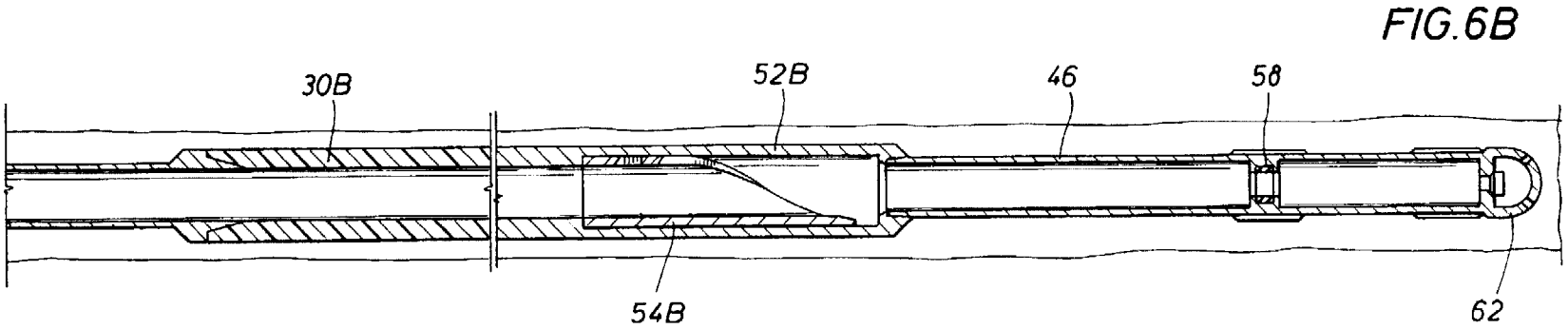

FIGS. 6A and 6B illustrate the tubular member as discussed above, with the work string and tail pipe 64 removed from the borehole. FIG. 6A illustrates the suitable hanger mechanism 68 for suspending or anchoring the liner 45 from the casing 42, which is fixed within the borehole. The composite tubular 45 may initially be suspended in the borehole from another working string (not shown) interconnected with the composite tubular 45 via thread 75. Various mechanisms may be used to cause the outer sleeve 76 to move downward relative to tubular member 46, thereby moving the upper slips 72 and the lower slips 74 into biting engagement with the casing 42, and simultaneously setting the packer member 74 for sealed engagement between the casing 42 and the composite tubular 45. Those skilled in the art will appreciate that the tubular string may be fixed to the casing 42 using either a mechanically set or hydraulically set mechanism. It should also be understood that the tubular member 46 or casing may alternatively extend to the surface. Accordingly, various techniques and equipment may be used for securing the composite tubular member within the borehole according to the present invention. Once the composite tubular is secured within the wellbore, the work string and tail pipe 64 be retrieved, with the interior of the composite tubular washed clean for performing the operations described below.

Figure 7:
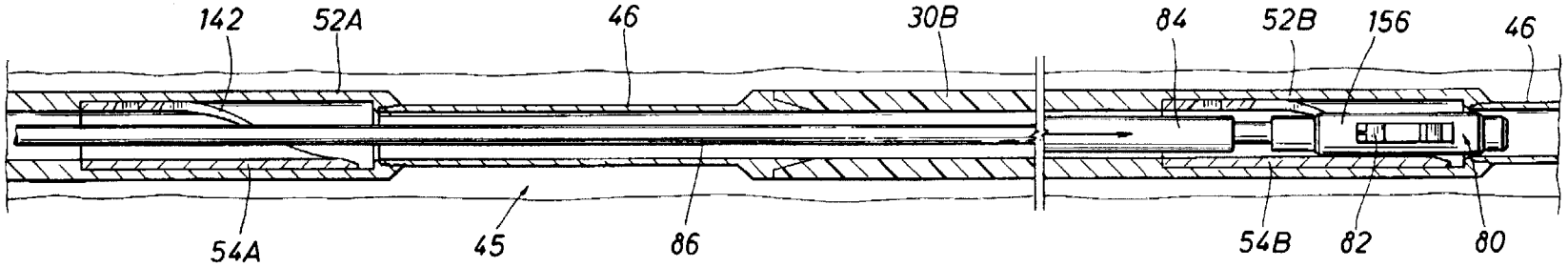
FIGS. 7 and 8 illustrate a composite material tubular and a locator tool for connection with a locator profile in the tubular for determining the orientation of the locator profile in the tubular.

FIG. 7 generally depicts a locator tool 80 according to the present invention positioned within the tubular string at the bottom of work string 86, which conveniently may be a coiled tubing string. The locator tool 80 includes a spring biased locator lug 82 which, when moved radially to its outward position, engages the edge surface 142 on the sleeves 54A and 54B. Each of the locator sleeves may be identical, and the edge 142 is more clearly depicted in FIG. 7 for the upper sleeve 54A. A conventional directional survey tool or orientation tool 84 may be provided above locator tool 80, and is suitable for determining the azimuth of lug 82 or radial position of lug 82 relative to the high side of the liner 45 when fitted within the locator slot within the sleeve 54B.

Figure 8:
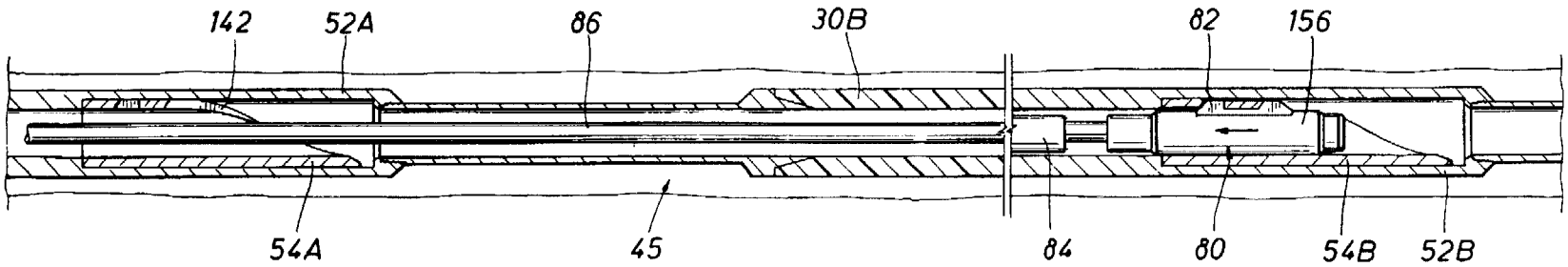

The general technique for manipulating the locator tool 80 and the directional survey tool 84 is shown in FIGS. 7 and 8. It should be understood that the locator tool and the directional survey tool may be formed as an integral tool, although preferably these tools are removably connected by standard threads so that the locator tool may be subsequently used with the whipstock assembly, as discussed below. Tools 80 and 84 may be lowered into the wellbore and into the composite tubular string 45 from a work string 86 or a wire line when in vertical wellbores.

A particular feature of the present invention is that the locator tool is lowered beneath the locator notch in the respective sleeve 54 until the locator tool engages a landing bore to activate the spring biased locator lug as will be described below. The lug 82 cooperates with the locator sleeve edge surface 142 to rotate the tools 80 and 84 as the tools are pulled upward within the composite tubular 30. When the lug 82 is moved radially outward with respect to the lug housing 156, as explained below, the lug 82 will engage the orienting edge surface 142 of the locator sleeve, thereby rotating the tools from the position as shown in FIG. 7 to the position as shown in FIG. 8. When the lug 82 is releasably locked within the slot in the locator sleeve 54B, the directional survey tool 84 is operated to determine the azimuth or radial position of the lug 82 and thus the slot in the locator sleeve. For an inclined or horizontal wellbore, those skilled in the art often refer to the azimuth as the radial location of the locator slot relative to the high side or top side of the tubular. The method required to obtain the directional survey using a conventional tool 84 are well known in the art, and thus are not discussed in detail in this application.

After the azimuth of the locator slot in the sleeve 54 has been determined, upward tension may be applied to the work string 86 to move the lug 82 radially inward and allow the lug to pass by the locator sleeve 54B and move further upward in the composite tubular. The same locator tool 80 and direction survey tool 84 may accordingly be used to determine the azimuth of the locator slot in the locator sleeve 54A. In this manner, the azimuth of each locator slot in the composite tubular may be determined. It should also be understood that the composite tubular may be assembled in such a manner that the azimuth of one locator slot with respect to another locator slot is known. If all the locator slots within the composite tubular are known relative to any one composite tubular, the determination of the azimuth of the reference locator slot will allow the well operator to determine the azimuth of each of the other locator slots, particularly when the axial spacing between the locator sleeves is relatively short. If the axial spacing between intended laterals and thus between locator sleeves is substantial, the downhole angular deflection due to twisting of tubular sections 46 may require that the locator tool and orientation tool be used to determine the azimuth of a particular locator slot shortly before the whipstock assembly is positioned to drill a lateral above that respective locator sleeve.

Figure 17:
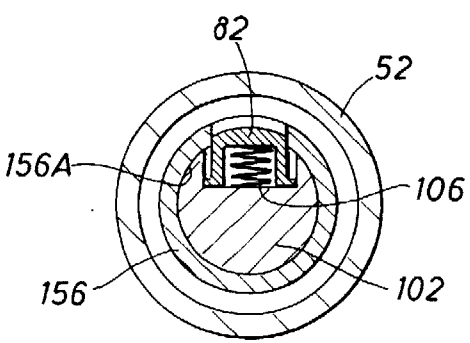
Figure 28:
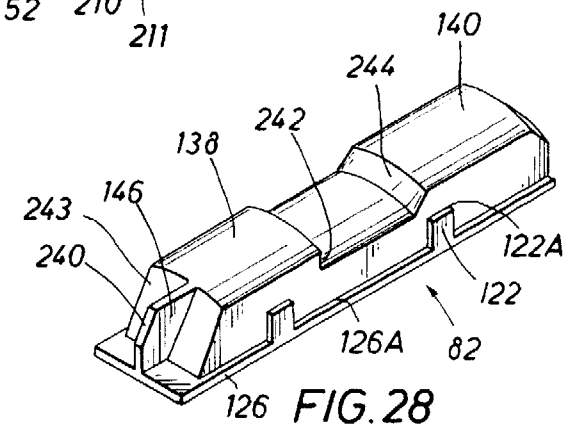
FIG. 28 is a pictorial view of a suitable locator lug for a locator tool according to the present invention.

FIG. 28 illustrates more clearly a suitable locator lug according to the present invention which may be contained within the generally cylindrical locator housing 156 as shown in FIGS. 7 and 17. Locator lug 82 includes a pair of axially spaced curved outer surfaces 138 and 140 which each match the general profile of the inner surface of the tubing section 52. A relatively thin front plate 146 of the lug includes a beveled front surface 240 for engagement with the orienting edge surface 142 of the sleeve 52, which is discussed in further detail below. For the present, it should be understood that the surface 240 contacts the edge surface 142 or 144, and is preferably provided on a thin plate 146 to ensure that the lug 82 will begin its initial rotation along the surface 142 or 144 toward the locator slot. The lug 82 also includes tapered surfaces 243 and 244 which are each inclined relative to a central axis of the locator tool, which is coaxial with both the central axis of the whipstock described subsequently and a central axis of the composite tubular. The taper on the surfaces 243 and 244 allows the lug to move radially inward so that the locator tool can be pulled upward past a locator sleeve.

Lug 82 also includes a stop surface 242 which lies within a plane substantially perpendicular to a central axis of the whipstock. A support surface on the locator sleeve also lies within a plane substantially perpendicular to the central axis of the tubular, so that the engagement of the stop surface 242 with the support surface on the locator sleeve prevents downward movement of the locator tool 80 with respect to the locator sleeve. It should be understood, however, that once the locator tool is moved upwardly within the composite tubular past a particular locator sleeve and is subsequently rotated less than one turn in either direction, the locator tool may thereafter be lowered beneath the locator sleeve since the lug 82 will then not be aligned with the slot in the locator sleeve.

Figure 11:
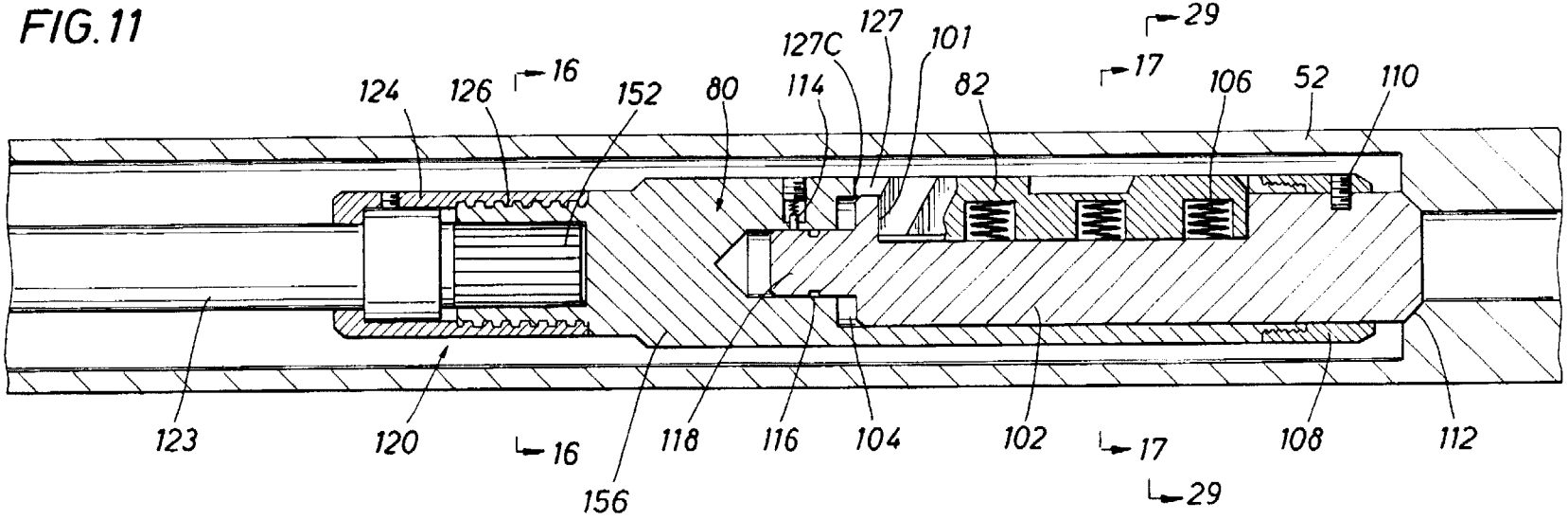
FIG. 11 illustrates one embodiment of an inactivated locator tool according to the present invention within a tubular.

As shown in FIGS. 11, 12, 17, and 18, a locator lug 82 may be supported on a central support 102 which is axially movable with respect to the lug housing 156. The lower end of the tubular string beneath the lowest fiberglass section may include a restricted bore, thereby forming a landing 112 for engagement with the lower end of the inner support member 102, as shown in FIG. 11. The landing 112 may be included within the packoff bushing 58 as shown in FIG. 5B. A downward force may be applied to the working string 86 as shown by the arrow in FIG. 7, or the locator tool may be landed on the surface 112 and raised a preselected distance in vertical wells and then dropped onto the landing 112, thereby shearing the pin 110 which interconnects the locator housing 156 with the inner support 102. A lower collar 108 is threaded to the housing 156 and supports the shear pin 110 which prevents axial movement of the locator lug 82 with respect to the housing 156.

Figure 12:
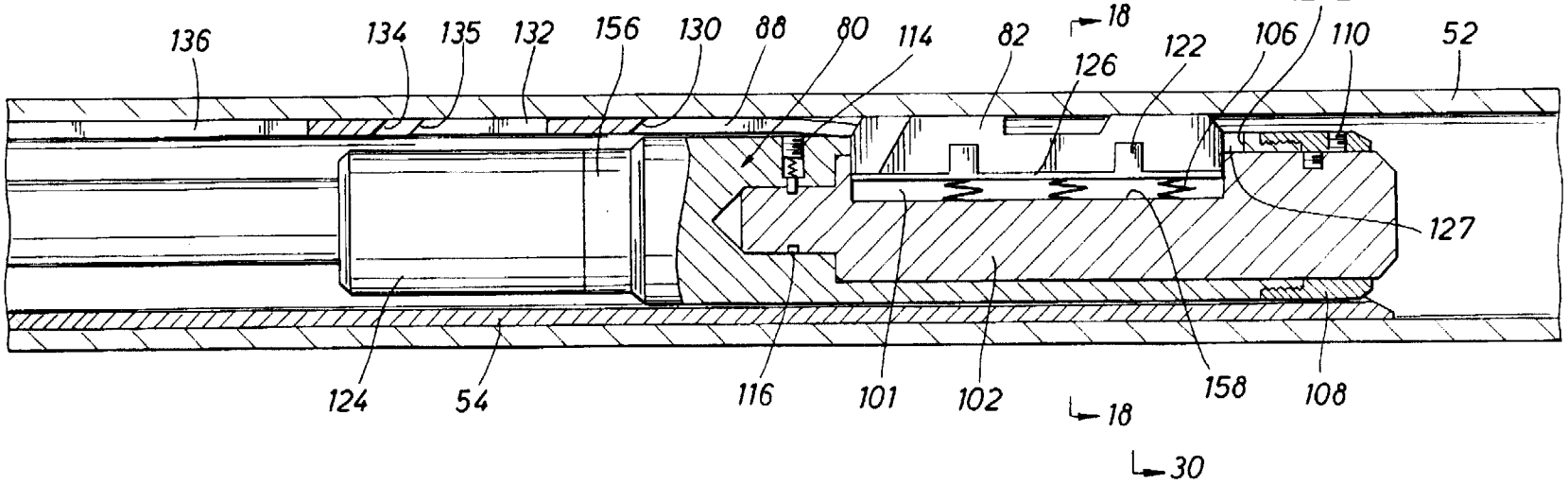
FIG. 12 illustrates the activated locator tool as shown in FIG. 11 in cooperation with a locator profile in the downhole tubular.
Figure 11A:
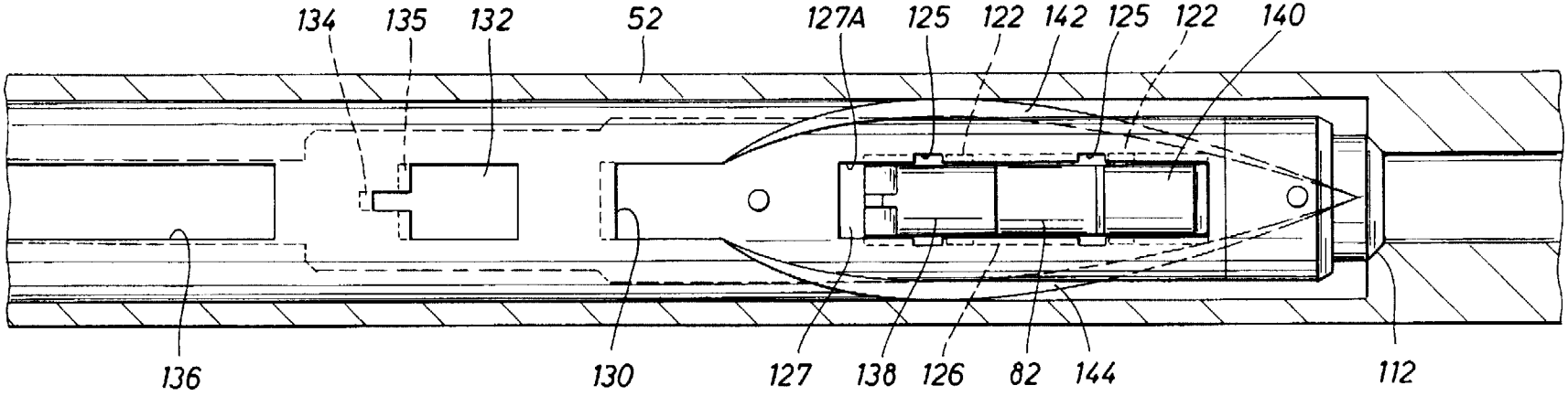
FIG. 11A is a top view of the locator tool shown in FIG. 11.
Figure 30:
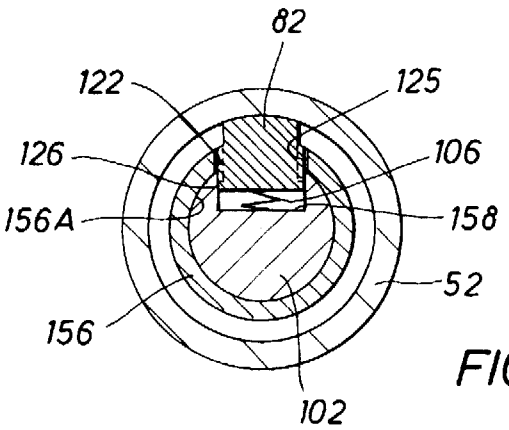
FIGS. 29 and 30 are cross-sectional views, along lines 29—29 and 30—30 of FIGS. 11 and 12, respectively deactivated and activated positions of the locator lug in the locator tool.
Figure 29:
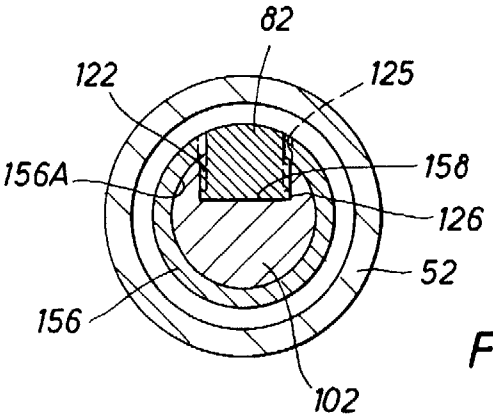

Referring to FIGS. 11, 11A and 12, the locator lug 82 is positioned or supported within a socket 101 of inner support 102 and is continuously urged outwardly from the socket by biasing springs 106 acting between the base surface 158 and inner support 102. In the inactivated position shown in FIG. 11, a portion of the spring biased locator lug 82 extends through a radial aperture 127 of housing 156 and is retained in a compressed position within the socket 101 of inner support 102 by means of the engagement of inner support ears 122 with the inner longitudinal surfaces 156A of housing 156 (see FIG. 29) adjacent the locator lug aperture 127. The locator lug aperture 127 is approximately the same width but slightly longer than the locator lug 82. Shearing of the member 110 allows the housing 156 to move downward relative to the inner support member 102 and the spring biased locator lug 82. This axial movement allows the locator lug and its ears 122 to be shifted from the lower end 127B to the upper end 127C of the aperture 127 and thus shifting the support ears 122 from the retaining position in engagement with the longitudinal surfaces 156A of the housing 156 (see FIG. 29) to an activated position with the ears 122 aligned with the ear profiles 125 located along the longitudinal edges of the locator lug aperture 127 (see FIG. 30). This action permits the locator lug ears 122 to move radially outward within the ear profiles 125 in response to the bias springs 106, thereby permitting the outward radial movement of the locator lug 82 through the aperture 127 of housing 156 until stopped or retained by the abutment of the ridge 126 of the locator lug with the inner surface of the housing 156. Those skilled in the art will appreciate that the springs 106 are conceptually shown in the drawings for biasing the lug 82 radially outward with respect to the central support 102, and that other biasing mechanisms could be used to achieve this objective.

This axial movement of the central support 102 thus closes the gap 104 as shown in FIG. 11. A central nose 118 at the upper end of the support 102 includes an annular groove 116. A spring biased pin 114 is provided in the housing 156 for sliding into the groove 116 as shown in FIG. 12 to lock the central support 102 in a position so that the lug 82 will thereafter be retained in the upward shifted position within aperture 127. As the locator tool is pulled upward from the work string, the locator lug 82 is in sliding engagement with the edge surface 88 as shown in FIG. 12, thereby causing the locator tool 80 and the directional survey tool 84 to rotate until the lug 82 is aligned for entering the slots in the locator sleeve 54.

Figure 16:
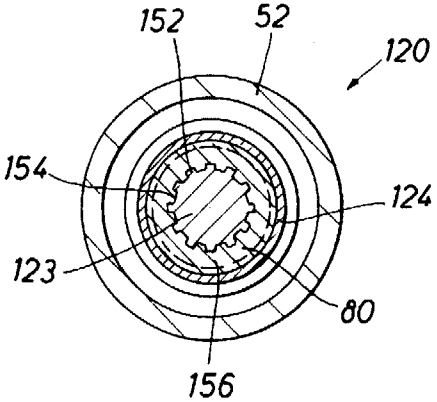
FIG. 16 is a cross-sectional view, along section line 16—16 of FIG. 11, illustrating a suitable mechanism for orienting the whipstock face with respect to the locator tool according to the present invention.
Figure 19:
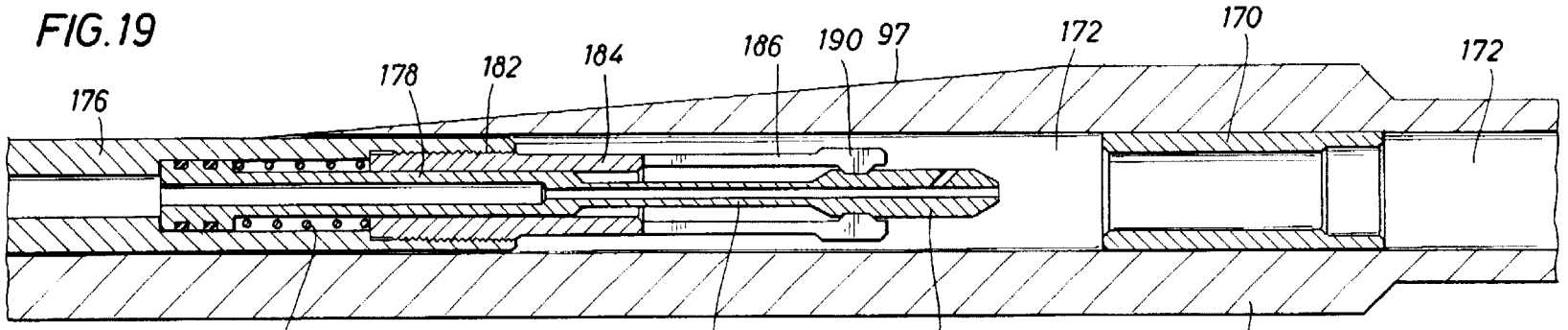
FIGS. 19–23 are half-sectional views illustrating a retrieving tool for positioning the whipstock within the tubular and for retrieving the whipstock to the surface.

FIGS. 11 and 16 also illustrate a suitable connection between the locator tool 80 and the whipstock described subsequently. Connection 120 includes orientation splines 152 on a central mandrel 123 which mate with splines 154 at the upper end of the locator housing 156. The splines enable the face of the whipstock tool, to be oriented in a desired incremental position relative to the lug 82 on the locator tool. Once the desired orientation has been obtained, the sleeve 124 may be threadably connected to the housing 156 at threads 126, thereby locking the orientation splines into position. At the surface, sleeve 124 may be easily unthreaded and the splines disengaged and then reengaged to achieve a predetermined angular relationship between the locator tool and the whipstock face 97. Only a few circumferentially spaced splines are shown in the figures to explain the purpose of this connection. In order to achieve the desired degree of resolution, 72 orientation splines may be provided about the circumference of the housing 156 and the mandrel 123, thereby providing a 5° resolution.

Figure 13:
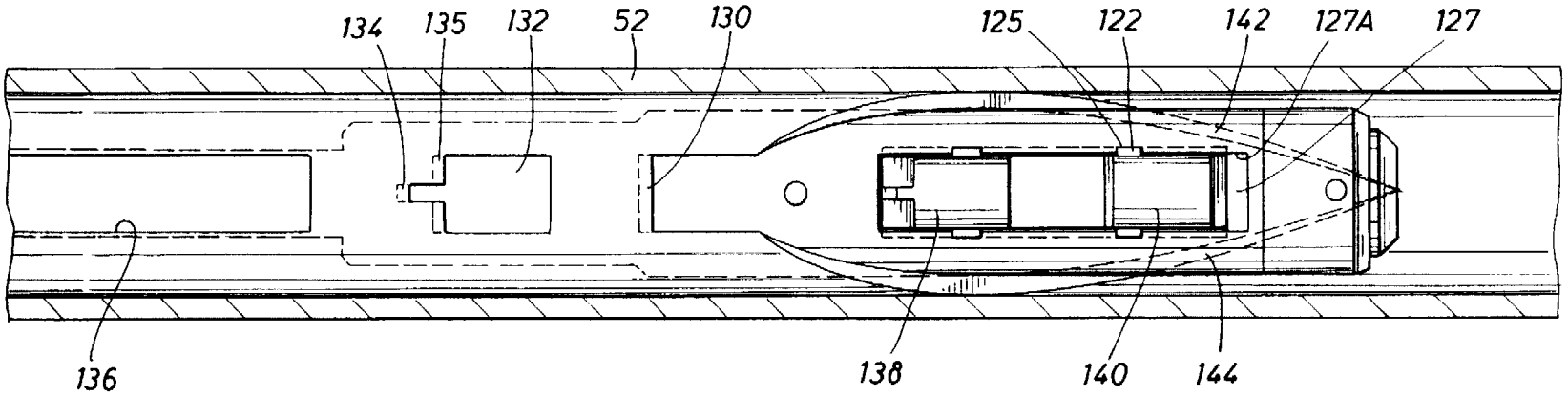
FIGS. 13, 14 and 15 illustrate the locator tool being positioned with respect to the locator profile in the tubular.
Figure 14:
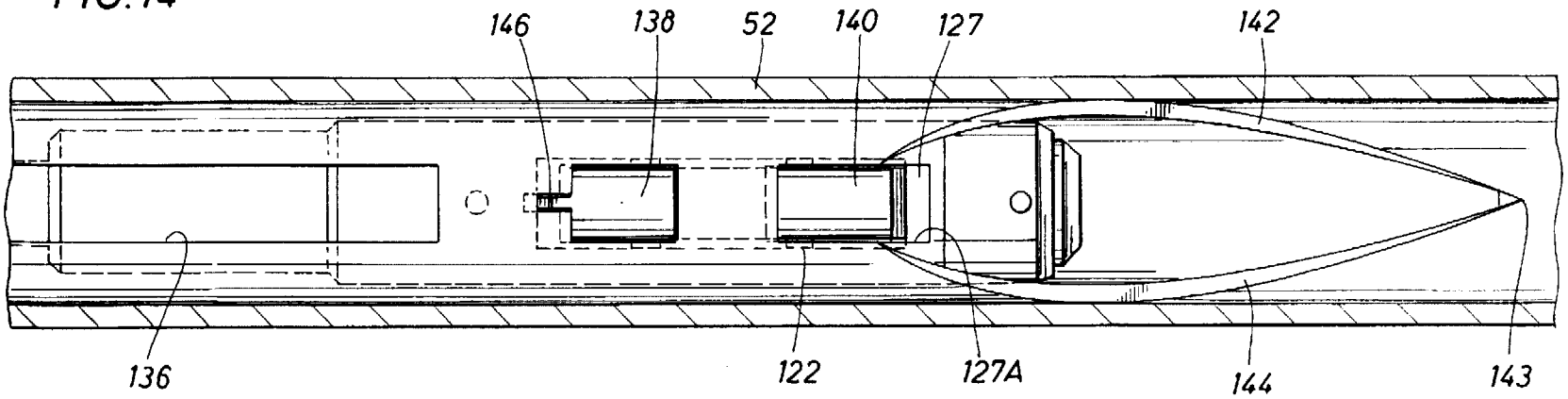

The configuration of each orienting edge surface 142 and 144 is shown in FIGS. 13 and 14. Those skilled in the art will appreciate that when lug 82 engages one of these surfaces, which will be at an arbitrary position between the lower point 143 where the surfaces mate and the locator slot, upward movement of the tool 80 thereafter causes the tools 80 and 84 to rotate until the lug is aligned for engagement with the slots in the locator sleeve.

FIGS. 12 and 13 illustrate a tapered surface 130 on the locator sleeve 54 for initial engagement with the surface 240 on the locator lug 82, thereby forcing the locator lug radially inward to compress the springs 106. Continued upward movement of the tool moves the surface 138 of the lug into the short locator slot 132, which contains inclined surface 135 for engagement with tapered surface 243 on the locator, and inclined surface 134 for engagement with the lead surface 240 of the lug. Each of the surfaces may have an inclination of approximately 45° with respect to the axis of the tubular. Since the force of the biasing springs 106 may be known or approximated, a selected axial pull on the work string, e.g., 5,000 pounds, will cause the lug to move radially inward so that surface 243 slides past surface 135, thereby axially moving the lug out of the short slot 132 location as shown in FIG. 14 and into the long slot 136.

Figure 15:
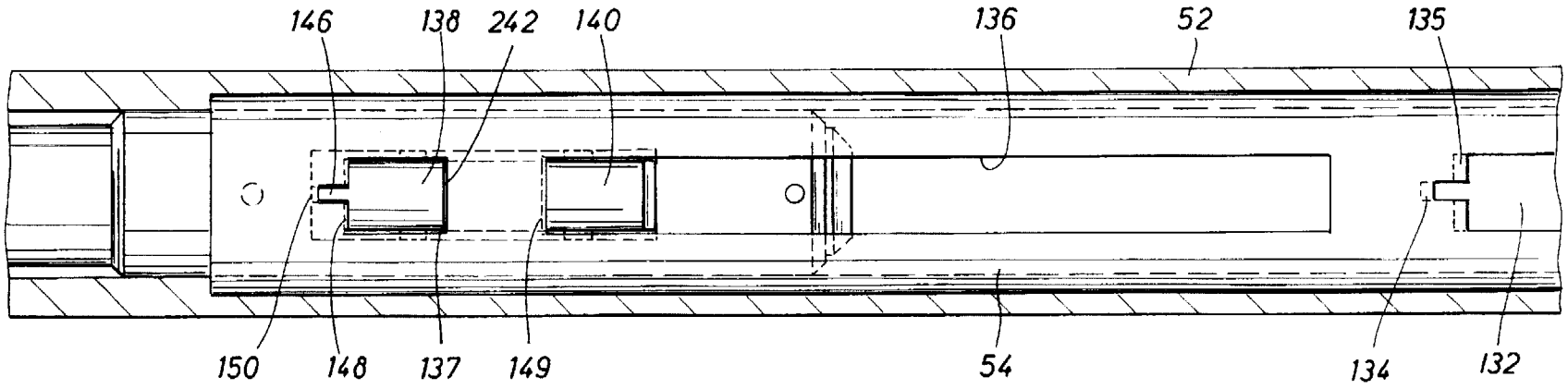
Figure 18:
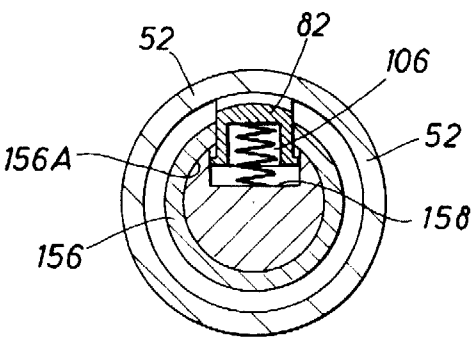
FIGS. 17 and 18 are cross-sectional views, along lines 17—17 and 18—18 of FIGS. 11 and 12, respectively, of a deactivated and an activated position of the biased locator lug in the locator tool.

Locator lug 82 will thus continue upward through the long slot 136 until the locator lug reaches the position as shown in FIG. 15. An advantage of the combination of the short slot 132 and the long slot 136 is that the operator will detect entry of the lug coming out of the short slot 132 because of the force required for the tapered surfaces to pass by one another, but may not be able to stop upward movement of the locator tool 80 until the locator lug passes into the long slot 136. If the locator lug comes to rest within the short slot, a preselected upward force on the working string will move the locator into the long slot, as described above. If the locator lug immediately passes by the short slot and into the long slot, this movement will be detected by the operator at the surface, and the locator tool travel may thereafter be easily controlled to ensure that the lug does not inadvertently pass out of the long slot 136. With the lug 82 positioned at the upper end of the long slot as shown in FIG. 15, the planar stop surface 242 on the locator will be in engagement with the support surface 137 on the locator sleeve 54, thereby preventing downward movement of the locator tool with respect to the tubular.

The tapered surfaces 148, 149, and 150 at the upper end of the long slot 136 may be angled so that a predetermined force in excess of that required to move the lug out of the short slot is necessary to compress the biasing springs 106 and allow the lug to move upward past the long slot. If the tapered surfaces at the upper end of the short slot have a 45° taper relative to the central axis of the tubular, the surfaces of the upper end of the long slot 136 may be angled at 30° relative to a plane perpendicular to the central axis. Accordingly, significantly more upward force, e.g., 10,000 pounds, is required to move the lug past the tapered surfaces at the end of the long slot 136.

Once positioned within the end of the long slot, the tool 80 will be properly located and the directional survey tool 84 will make a determination of azimuth of the lug 82 and thus the slot 136 within the downhole tubular. After this determination has been made, an upward force may be applied to the work string to move the locator tool 80 to another position within the composite tubular, where the above described operation may be repeated.

Figure 9:
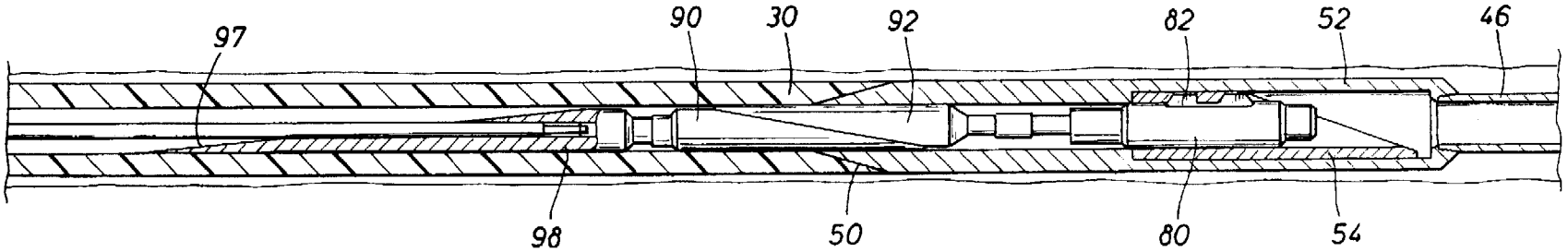
FIG. 9 illustrates a composite material tubular with a whipstock assembly including a wedge mechanism and a locator tool positioned for drilling a lateral.
Figure 10:
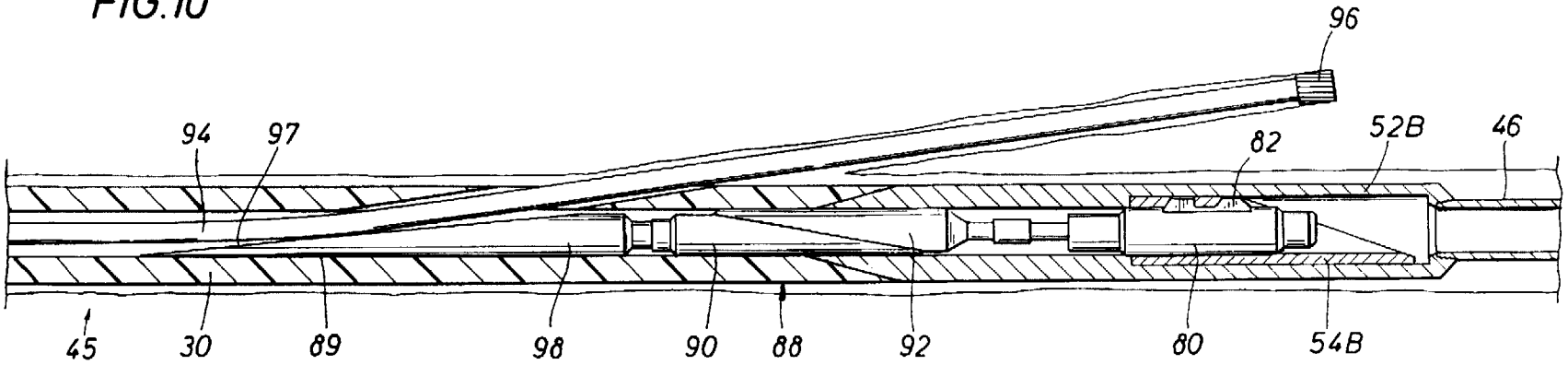
FIG. 10 illustrates a formation bit drilling into a formation of interest after cooperating with a whipstock assembly for drilling a window through a composite tubular.

After the whipstock face has been properly oriented relative to the lug at the surface, the whipstock assembly including a lower locating tool 80, an intermediate wedge mechanism 88, and a whipstock body having an upper whipstock face may then be lowered into the composite tubular, and the tool 80 again located within the composite tubular as described above. FIGS. 9 and 10 conceptually illustrates locator tool 80 with the locator lug 82 thereon already in engagement at the end of the long slot within the locator sleeve 54. Much of the detail of the locator sleeve discussed above is not repeated in FIGS. 5A–10. Although the whipstock body and the locator tool may be formed as one assembly, preferably the same locator tool 80 used in conjunction with the directional survey tool 84 described above is re-connected by the spline connections to the wedge mechanism to orient the whipstock face at a desired azimuth for drilling of a lateral. The combination whipstock assembly as shown in FIGS. 9 and 10 may thus be lowered below the locator sleeve 54, and the lug 82 brought into engagement with the locator sleeve according to the sequence described above. This positioning of the lug 82 will thus position the face of the whipstock within the fiberglass section 30 of the tubular, as shown in FIG. 9, and will orient the face in a desired azimuth for drilling of a lateral.

FIG. 10 illustrates a conventional bit 96 at the end of string 94, which optionally may be rotated by a mud motor at the end of either a conventional tubing string or a coiled tubing string. The bit 94 will engage the face 97 of the whipstock body 98, and will be directed thereby to easily drill a window through the fiberglass material section 30. According to the present invention, the same bit 96 may then continue to drill the lateral into the formation of interest. Change out of bits is thus not required after drilling a window through the tubular.

Figure 24:
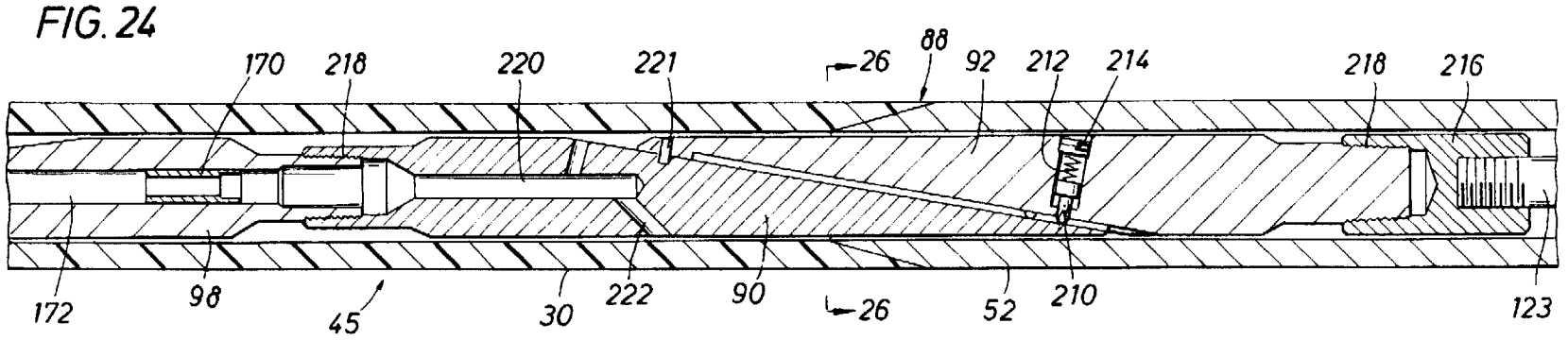
FIGS. 24 and 25 are half-sectional views illustrating a wedge mechanism for positioning the whipstock surface radially opposite the whipstock face into planar engagement with the downhole tubular.
Figure 25:
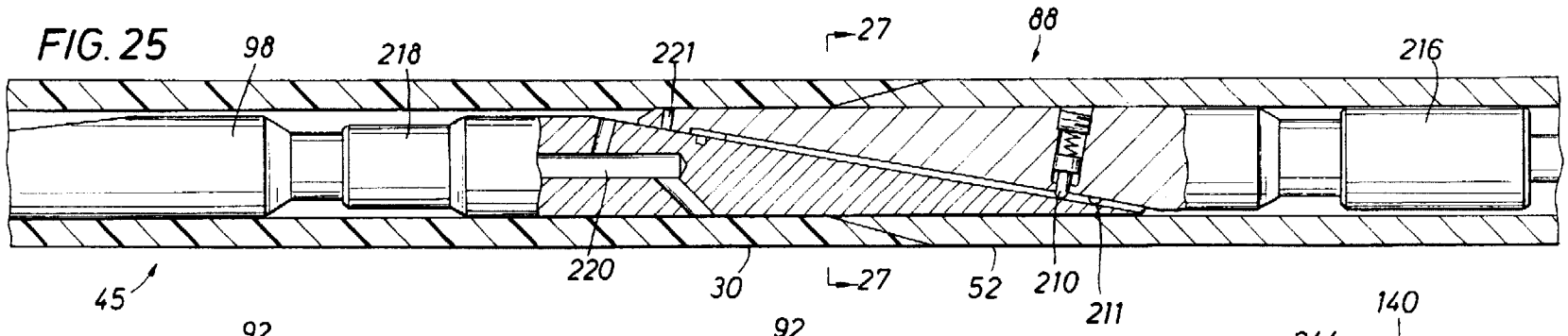
Figure 27:
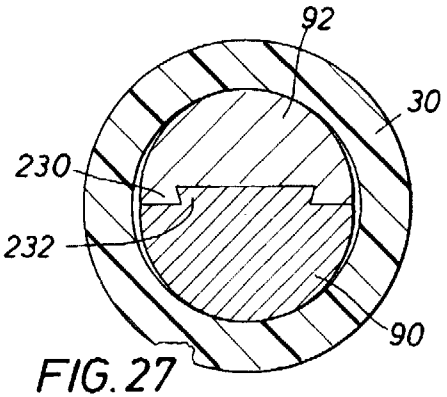
FIGS. 26 and 27 age cross-sectional views, along section lines 26—26 and 27—27, of the wedge mechanism as shown in FIGS. 25 and 26, respectively.
Figure 26:
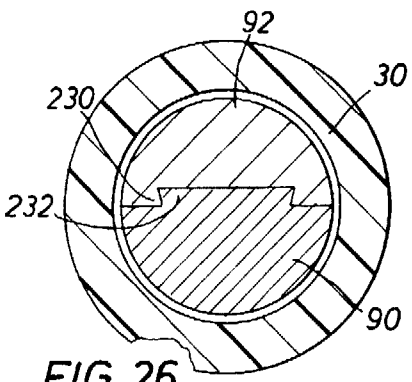

The whipstock assembly as shown in FIG. 10 also includes wedge mechanism 88 for forcing the curvilinear surface 89 of the whipstock body 98 radially opposite the face 97 into pressed engagement with the interior surface of the fiberglass tubular section 30, as shown in FIGS. 9 and 10. As shown in FIGS. 24 and 25, the assembly 88 includes an upper body 90 having a plurality of flow ports 220 and 222 therein for maintaining fluid communication between the bore 172 in the whipstock body 98 and the annulus between the tubular and the exterior of the wedge mechanism 88. The upper body 90 may be threadably connected to the lower end of the whipstock body 98 at threads 218, or may be constructed as an integral part of whipstock body 98. Assembly 88 also includes a lower body 92 which is interconnected with locator tool 80 by mandrel 123 (see FIG. 11). The outer curvature of the wedge mechanism has a diameter less than the interior surface of the tubular, as shown in FIG. 24, to facilitate run-in of the whipstock assembly. The ports in the upper and lower bodies 90 and 92 thus allow fluid communication from above to below the whipstock assembly, whether in the run-in position as shown in FIG. 24 or the set position as shown in FIG. 25. The gap between the bodies 90 and 92 and the interior of section 52 is shown in FIGS. 26 and 27. Production fluid is thus permitted to flow past the whipstock assembly even if the assembly is not retrieved to the surface. A conventional coupling 216 may be used for connecting the lower body 92 at threads 218 with the mandrel 123, which in turn is connected to the locator tool 80.

FIG. 24 shows the wedge mechanism 88 in the run-in position, with pin 221 preventing axial movement of the bodies 90 and 92 relative to each other along their sliding surfaces. FIGS. 26 and 27 illustrate that the bodies 90 and 92 are interconnected by dovetail profiles 230 and 232. With the lug 82 locked to a locator sleeve and prevented from downward movement with respect to the tubular, downward force may be applied to the work string to cause pin 221 to shear, thereby allowing sliding engagement of the surfaces on bodies 90 and 92, and causing radially outward expansion of the assembly 88 in a direction perpendicular to the sliding surfaces and into engagement with the interior surface of the tubular section 52, as shown in FIG. 27. This action thus forces the curvilinear surface of the body 90 into engagement with the interior surface of the tubular 45, thereby desirably forcing the curvilinear surface 89 radially opposite the whipstock face 97 into engagement with the interior surface of the composite tubular. Sliding engagement of the bodies 90 and 92 thus presses the whipstock radially into engagement with the tubular at a position opposite the whipstock face. The sliding engagement of these surfaces as shown in FIG. 25 also creates a high frictional force with the tubular which, combined with engagement of the locator lug 82 within the slots of the locator sleeve 54, prevents rotation of the whipstock assembly during the drill out operation.

The pin 221 may retain the bodies 90 and 92 in a position as shown in FIG. 24 during the run-in position. After drilling of a lateral, an upward force on the work string will cause the pin 210, biased by spring 212, to engage recess 211 in the body 90. Plug 214 holds the spring 212 and pin 210 within the body 92. The whipstock assembly as described herein is fully retrievable, and accordingly movement of the pin 210 back into the recess 211 will allow the assembly to achieve its unactivated configuration, as shown in FIG. 24. The expanded wedge configuration as shown in FIG. 25 may thereafter again be achieved by applying a downward force through the work string after location of the locator lug within the locator sleeve of a composite joint, as discussed above.

Those skilled in the art will appreciate that the whipstock assembly as described herein may be positioned within each of the non-ferrous sections of a composite tubular for easily drilling a window through each non-ferrous section. A lateral may then be drilled into a formation of interest by initially drilling through the lowermost non-ferrous section 30 within a well. After drilling the lowermost lateral, the combination whipstock and locator tool may be moved to the next upward locator sleeve, where the lug 82 serves to position the whipstock face at a desired axial location within the composite tubular and at the desired azimuth for drilling that lateral. Each of the multiple laterals within a well may thus be drilled with the whipstock assembly including the wedge mechanism and locator tool remaining downhole. Alternatively, the combination whipstock assembly may be retrieved to the surface after drilling each lateral. Prior to returning the tool downhole, the whipstock assembly may be checked and, if desired, the orientation of the whipstock face relative to the slot in the locator sleeve associated with the next lateral to be drilled may be easily adjusted.

Figure 20:
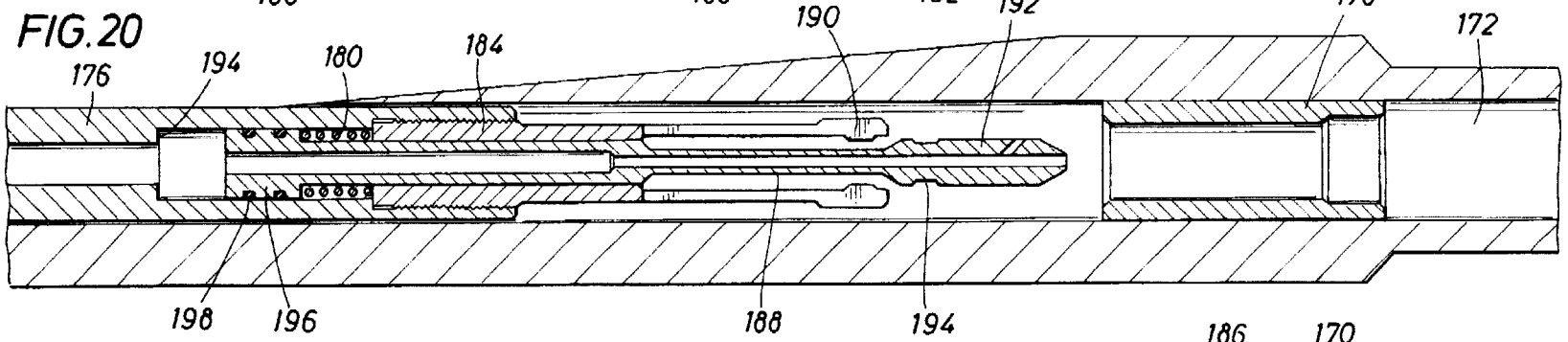
Figure 21:
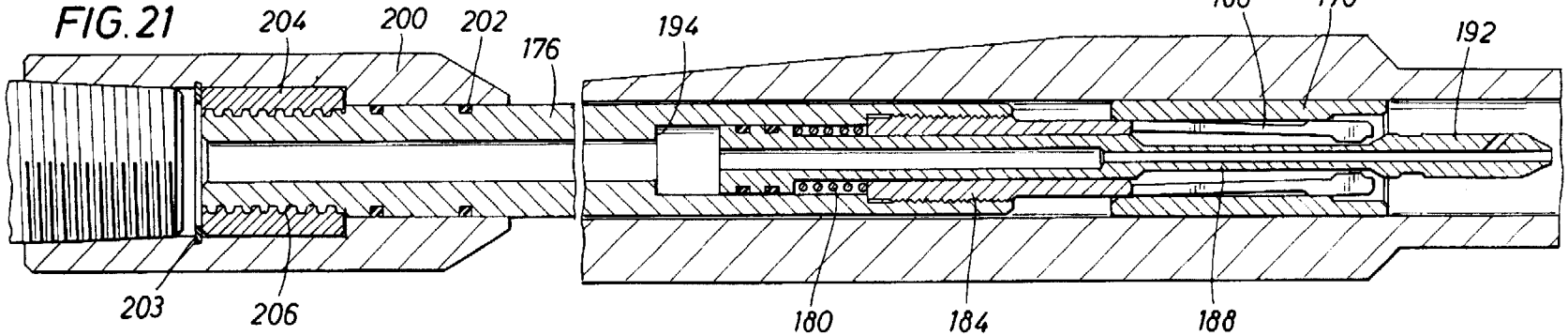

FIGS. 19–23 illustrate a retrieving tool according to this invention to conveniently position the whipstock assembly within the tubular and to retrieve the whipstock assembly to the surface. The retrieving tool includes a mandrel 176 which may be threadably connected at its upper end to a work string. FIG. 21 illustrates the upper end of the mandrel 176 in engagement with a connector 200, which includes threads for thread connection with a conventional work string. Sealed engagement of the connector 200 and the mandrel 176 is provided by O-ring seals 202. Ring member 204 with threads 206 may be used for structurally interconnecting the upper end of the mandrel 176 with the connector 200. A snap ring 203 prevents the ring member from moving upward toward the work string.

Collet sleeve 184 is threadably connected to the mandrel 176 at threads 182. A plurality of circumferentially spaced collet fingers 186 each extend downward from collet sleeve 184. Each of the collet fingers 186 may have the lower expanded end 190 which, in the run-in position, cooperates with the biasing action of the spring 180 to retain a piston 196 in engagement with the stop surface 194 on the mandrel 176. The piston 196 carries seals 198, and includes a flow passageway therein which continues through the sleeve 188 which interconnects the piston 196 with a discharge end member 192. The retrieving tool may be run into a well and into the bore 172 in the whipstock assembly, and positioned for engaging catch sleeve 170 fixed within the bore 172. During positioning of the retrieving tool, fluid be may passed through the retrieving tool and into the bore 172 of the whipstock assembly, thereby washing debris from the bore and exposing cleaned sleeve 170 to the retrieval tool. Once properly positioned within the bore 172 as shown in FIG. 20, fluid pressure to the tool may be increased, thereby causing the piston 196 to move downward, as shown in FIG. 20, compressing the spring 180. This movement of piston 196 thus causes the enlarged end member 192 to drop below the collet fingers 186, thereby releasing ends 190 from the annular slot 194. The flow passageway described above allows the continued discharge of fluid from the retrieval tool.

Figure 22:
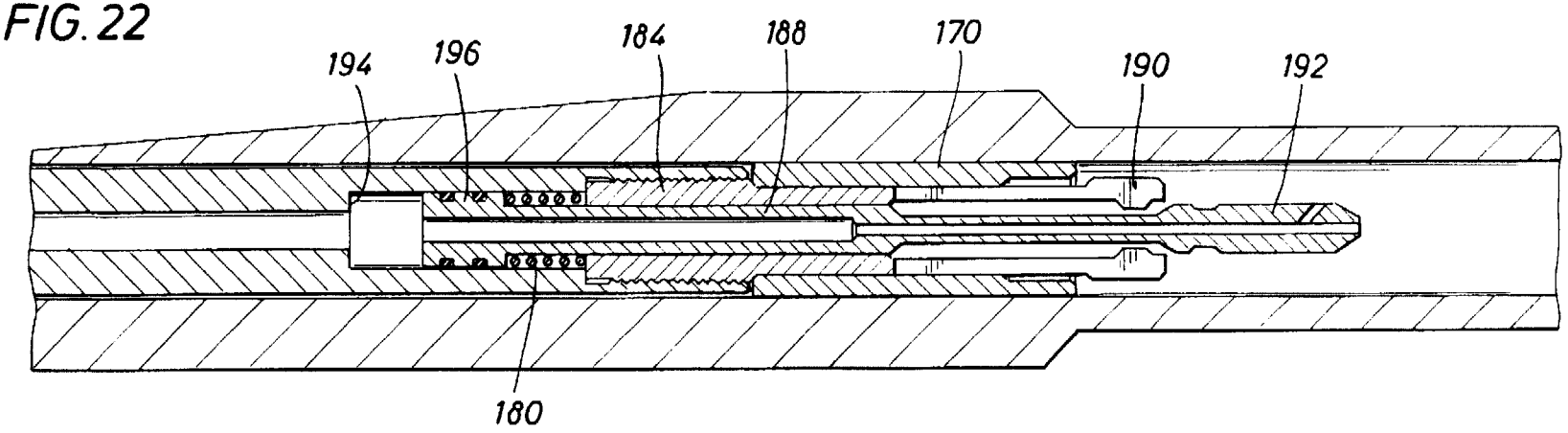
Figure 23:
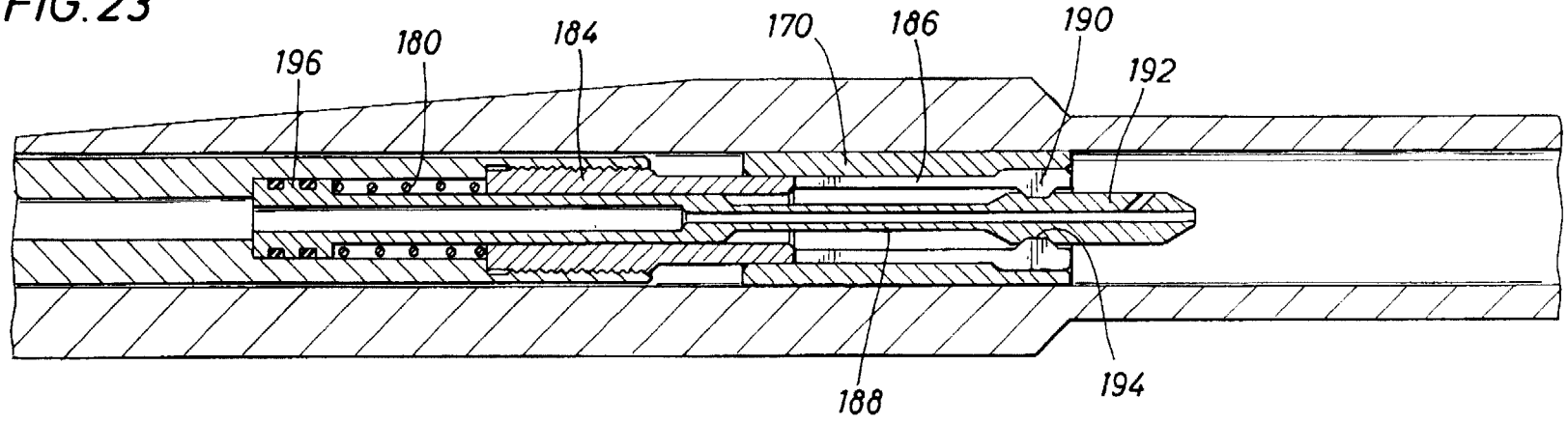

FIG. 21 illustrates that the retrieving tool has been lowered so that collet fingers 186 engage the restriction sleeve 170 within the bore of the whipstock, thereby moving radially inward the ends 190 from the position as shown in FIG. 20. Continued downward movement of the retrieving tool to the position as shown in FIG. 22 allows the ends 190 to expand radially outward to their original position. FIG. 22 also illustrates the collet sleeve 184 in engagement with the restriction sleeve 170, thereby limiting further downward travel of the retrieving tool and ensuring the operator that the components are positioned as shown in FIG. 22. Once this position has been obtained, hydraulic pressure on the work string may be ceased, thereby allowing the biasing spring 180 to return the piston into engagement with the stop surface 194 as shown in FIG. 23, and causing the ends 190 to re-engage the groove 194 in the end member 192. The retrieving tool will then be fixed to the whipstock assembly in the position as shown in FIG. 23 for moving the whipstock assembly in the tubular using the work string, or for reliably retrieving the whipstock assembly. During the operation of fixing the tool to the whipstock assembly, fluid may be continually pumped through the retrieving tool to wash debris from the bore of the whipstock assembly.

Those skilled in the art will appreciate from the above disclosure that the composite tubular of the present invention preferably includes a non-ferrous material portion, which is relatively soft compared to the ferrous material portion of the composite tubular. A non-ferrous portion of the composite tubular is preferably formed from a fiberglass material, although various non-ferrous materials easily drillable by a bit may be used. In some operations, aluminum may be used as the non-ferrous material, although fiberglass is less susceptible to degradation from many downhole fluids. The ferrous material portion of the tubular must have sufficient strength to cooperate with the locator tool as disclosed herein to support the whipstock assembly, and may be conveniently formed from various ferrous materials commonly used in downhole tools, depending upon the characteristics of the fluid in the borehole.

The present invention is particularly well suited for drilling a lateral using a PDC bit. The tubular string for rotating the bit may extend to the surface, and in that instance may be comprise a coiled tubing string. Alternatively, the tubing string may extend from the surface downhole to a mud motor, which then drives the bit according to techniques well known to those skilled in the art.

Terms such as "upward" and "downward" have been used throughout this specification to conveniently describe the invention in association with the drawings. It should be understood that such terms are used for explanation purposes and are not to be construed as limiting the invention. Those skilled in the art will recognize that the orientation and configuration of the equipment described herein may be different from that illustrated in the accompanying drawings, and that this terminology is used for ease of understanding the presently preferred embodiments of the invention.

Various modifications to the equipment and to the methods described herein will also be apparent from the above description of the preferred embodiments. It should be apparent to those skilled in the art that modifications and changes of these preferred embodiments may be made without departing from the scope and spirit of the invention. The invention accordingly is not restricted to the embodiments disclosed herein, and instead includes modifications within the scope of the following claims.

What is claimed is:

1. An assembly for drilling a lateral from a borehole into a formation of interest, the assembly comprising:

an elongate tubular secured within the borehole, the tubular having one or more tubular non-ferrous material portions along the length thereof, each tubular non-ferrous portion having a tubular ferrous material portion spaced axially below the tubular non-ferrous portion;

one or more whipstock locators each fixed to a respective tubular ferrous portion at a desired axial spacing relative to a respective tubular non-ferrous portion above the ferrous portion, each whipstock locator including a locator sleeve having a bore therethrough and a locator notch in the locator sleeve;

a whipstock assembly including a radially movable lug for engagement with the locator notch to fix the whipstock assembly in a selected azimuth orientation within the tubular and in a selected axial position such that a whipstock face is within the respective non-ferrous portion of the tubular;

a locator tool movable within the tubular for engagement with the locator notch to determine the azimuth of the locator notch;

the whipstock assembly including an adjustment member for circumferentially adjusting the position of the lug relative to the whipstock face to selectively control the azimuth of the whipstock face when the whipstock is fixed on a respective locator and thus the azimuth of the drilled lateral; and a drill bit for engaging the whipstock face and drilling a window through the tubular non-ferrous portion of the tubular and then into the formation of interest.

2. The assembly as defined in claim 1, wherein the tubular includes a plurality of axially spaced tubular non-ferrous portions each formed from a fiberglass material and a plurality of tubular ferrous material portions each spaced adjacent and below a respective tubular non-ferrous portion, each tubular ferrous material portion having a respective one of the whipstock locators thereon.

3. The assembly as defined in claim 1, further comprising:

the whipstock assembly including a lug housing;

the lug being axially movable with respect to the lug housing;

a biasing member for biasing the lug in a radially outward position; and a stop on the lug housing for preventing radially outward movement of the lug until the lug moves axially from a deactivated position to a release position.

4. The assembly as defined in claim 3, further comprising:

a shear member for maintaining the lug axially in the deactivated position until the shear member is severed.

5. The assembly as defined in claim 1, wherein:

the lug has a stop surface lying within a plane substantially perpendicular to a central axis of the whipstock assembly; and the locator sleeve has a support surface lying within a plane substantially perpendicular to a central axis of the tubular, such that engagement of the stop surface and the support surface prevent downward movement of the whipstock assembly with respect to the locator sleeve.

6. The assembly as defined in claim 1, wherein:

at least one of the locator sleeve and the lug having a tapered lead surface inclined relative to a central axis of the whipstock assembly, such that upward movement of the whipstock assembly causes the tapered lead surface to force the lug radially inward to move the lug past the locator sleeve.

7. The assembly as defined in claim 1, wherein the locator sleeve includes an orienting surface below the locator notch for rotating the lug into alignment with the locator notch.

8. The assembly as defined in claim 1, wherein the whipstock assembly further comprises:

a whipstock body including a curvilinear exterior surface radially opposite the whipstock face for engagement with an interior surface of the tubular;

an upper tapered surface fixed with respect to the whipstock face; and a lower tapered surface for sliding engagement with the upper tapered surface to force the curvilinear surface into engagement with the tubular.

9. The assembly as defined in claim 8, further comprising:

a latch mechanism for preventing sliding engagement of the lower tapered surface with respect to the upper tapered surface; and a release mechanism for releasing the latch mechanism.

10. The assembly as defined in claim 1, wherein the whipstock assembly includes a whipstock body having an elongate bore therein extending axially downward from the whipstock face, and a catch sleeve within the elongate bore.

11. The assembly as defined in claim 10, further comprising:

a whipstock retrieving tool including a plurality of collet fingers for secured engagement with the catch sleeve within the elongate bore of the whipstock, the retrieving tool further including a fluid pressure responsive piston movable to limit radially inward movement of the collet fingers to selectively connect the whipstock assembly with the retrieving tool.

12. An assembly for drilling multiple laterals through a tubular secured downhole within a borehole, the assembly comprising:

a plurality of axially spaced locators each fixed downhole to the tubular, each locator including a radially outward extending locator notch therein;

a locator tool movable within the tubular for engagement with the locator notch to determine the azimuth of the locator notch;

a whipstock assembly including a radially movable lug for engagement with the locator notch to fix the whipstock assembly in a selected axial position and in a selected azimuth within the tubular; and the whipstock assembly including an adjustment member for rotatably adjusting the position of the lug relative to a whipstock face to selectively control the azimuth of a drilled lateral.

13. The assembly as defined in claim 12, wherein the whipstock assembly further comprises:

a whipstock body including a curvilinear exterior surface radially opposite the whipstock face for engagement with an interior surface of the tubular;

an upper tapered surface fixed with respect to the whipstock face; and a lower tapered surface for sliding engagement with the upper tapered surface to force the curvilinear exterior surface on the whipstock body into engagement with the tubular.

14. The assembly as defined in claim 12, wherein:

the lug has a stop surface lying within a plane substantially perpendicular to a central axis of the whipstock assembly; and each whipstock locator includes a locator sleeve having a support surface lying within a plane substantially perpendicular to a central axis of the tubular, such that engagement of the stop surface and the support surface prevents downward movement of the whipstock assembly with respect to the locator sleeve.

15. The assembly as defined in claim 14, wherein:

at least one of the locator sleeve and the lug having a tapered lead surface inclined relative to a central axis of the whipstock assembly , such that upward movement of the whipstock assembly causes the tapered lead surface to force the lug radially inward to move the lug past the locator sleeve.

16. The assembly as defined in claim 12, further comprising:

the whipstock assembly including a lug housing;

the lug being axially movable with respect to the lug housing; and a biasing member for biasing the lug in a radially outward position.

17. The assembly as defined in claim 12, further comprising:

the whipstock assembly including a whipstock body having an elongate bore therein extending axially downward from the whipstock face, and a catch sleeve within the elongate bore; and a whipstock retrieving tool including a plurality of collet fingers for secured engagement with the catch sleeve within the elongate bore of the whipstock, the retrieving tool further including a fluid pressure responsive piston movable to limit radially inward movement of the collet fingers to selectively connect the whipstock assembly with the retrieving tool.

18. A whipstock assembly for drilling a lateral through a tubular secured downhole within a borehole, the whipstock assembly comprising:

a lower locator tool movable within the tubular and including a radially movable lug for secured engagement with a locator notch in the tubular to fix the whipstock assembly in a selected axial position and in a selected azimuth within the tubular;

an upper whipstock body including a curvilinear exterior surface radially opposite a whipstock face;

a wedge mechanism positioned between the lower locator tool and the upper whipstock body for forcing the exterior surface of the whipstock body into engagement with the tubular; and an adjustment member for rotatably adjusting the position of the lug relative to a whipstock face to selectively control the azimuth of a drilled lateral.

19. The whipstock assembly as defined in claim 18, wherein the wedge mechanism further comprises:

an upper tapered surface fixed with respect to the whipstock face;

a lower tapered surface for sliding engagement with the upper tapered surface to force the curvilinear exterior surface on the whipstock body into engagement with the tubular.

20. The whipstock assembly as defined in claim 19, wherein the wedge mechanism further comprises:

a latch mechanism for preventing sliding engagement of the lower tapered surface with respect to the upper tapered surface; and a release mechanism for releasing the latch mechanism.

21. The whipstock assembly as defined in claim 18, further comprising:

the lower locator tool including a lug housing; and the lug being axially movable with respect to the lug housing.

22. The whipstock assembly as defined in claim 21, further comprising:

a biasing member for biasing the lug in a radially outward position; and a stop on the lug housing for preventing radially outward movement of the lug until the lug moves axially from a deactivated position to a release position.

23. A method of drilling a lateral from a borehole into a formation of interest, the method comprising:

securing an elongate tubular within the borehole, the tubular having one or more axially spaced tubular non-ferrous material portions along the length thereof, each tubular non-ferrous portion having a tubular ferrous material portion spaced axially below a respective one of the one or more tubular non-ferrous portions;

fixing a locator sleeve within the ferrous portion of the tubular to form a whipstock locator at a desired axial spacing relative to the respective non-ferrous portion, the locator sleeve having a bore extending axially therethrough and a locator notch extending radially partially through a wall of the tubular for engagement with the lug on the whipstock assembly;

lowering a whipstock assembly with a lug thereon below the locator;

raising and rotating the whipstock assembly to releasably interconnect the lug and the locator and thereby secure the whipstock assembly both in a selected one of a plurality of selectable azimuth orientations within the tubular, and in a selected one of a plurality of selectable axial positions, such that a whipstock face is within a respective non-ferrous portion of the tubular; and rotating a drill bit while engaging the whipstock face to drill a window through a selected one of the non-ferrous portions of the tubular at a selected azimuth orientation, and thereafter continuing to rotate the drill bit to drill a lateral into the formation of interest.

24. The method as defined in claim 23, further comprising:

using a mud motor at the lower end of a coiled tubing string for rotating the drill bit to drill the window through the non-ferrous portion of the tubular.

25. The method as defined in claim 23, further comprising:

positioning a locator tool downhole for engagement with the locator to determine the azimuth of the locator the notch; and rotatably adjusting the position of the lug relative to the whipstock face to selectively control the azimuth of a drilled lateral.

26. The method as defined in claim 23, further comprising:

biasing the lug in the radially outward position;

positioning a stop for engagement with the lug to prevent radially outward movement of the lug; and moving the lug to a release position such that the lug is moved out of engagement with the stop.

27. The method as defined in claim 23, further comprising:

providing an upper tapered surface on the whipstock assembly fixed with respect to the whipstock face;

providing a lower tapered surface on the whipstock assembly;

slidably engaging the upper tapered surface and the lower tapered surface to press a curvilinear exterior surface of the whipstock assembly radially opposite the whipstock face into engagement with the tubular.

28. The method as defined in claim 23, further comprising:

providing a stop surface on the lug substantially perpendicular to a central axis of the whipstock;

providing a support surface on the locator sleeve substantially perpendicular to a central axis of the tubular; and engaging the stop surface and the support surface to prevent downward movement of the whipstock assembly with respect to the locator sleeve.

29. The method as defined in claim 23, further comprising:

providing a tapered lead surface on at least one of the locator sleeve and the lug, the tapered lead surface being inclined relative to a central axis of the whipstock assembly; and moving the whipstock assembly upward within the tubular to cause the lead surface to force the lug radially inward and release the lug from the whipstock locator.

30. The method as defined in claim 23, further comprising:

after drilling the lateral, raising the whipstock assembly to temporarily interconnect the lug with another locator above the drilled lateral; and thereafter rotating the drill bit while engaging the whipstock face to drill another window through another non-ferrous portion of the tubular.

31. The method as defined in claim 25, wherein the lug is circumferentially adjusted relative to the whipstock face while the whipstock assembly is at the surface of the well.

32. An assembly for drilling a lateral from a borehole into a formation of interest with a drill bit, the assembly comprising:

an elongate tubular string secured within the borehole, the tubular defining a sealed flow path therethrough for transmitting fluids through the borehole;

one or more whipstock locators each positioned at a fixed axial location and circumferential position along the tubular string, each whipstock locator including a locator sleeve having a sealed bore therethrough in fluid communication with the flow path in the tubular string and a locator notch extending partially through a wall in the tubular string;

a whipstock assembly including a radially movable lug for engagement with a selected one of the one or more whipstock locator notches to fix the whipstock assembly in the tubular string and at a selected axial position; and an adjustment member for circumferentially adjusting the position of the lug relative to a whipstock face to selectively control the azimuth of the whipstock face and thus the drilled lateral, such that the drill bit may engage the whipstock face to drill a window through the tubular.

33. The assembly as defined in claim 32, wherein:

the lug has a stop surface lying within a plane substantially perpendicular to a central axis of the whipstock assembly; and the locator sleeve has a support surface lying within a plane substantially perpendicular to a central axis of the tubular, such that engagement of the stop surface and the support surface prevent both downward and rotation movement of the whipstock assembly with respect to the locator sleeve.

34. The assembly as defined in claim 32, wherein:

at least one of the locator sleeve and the lug having a tapered lead surface inclined relative to a central axis of the whipstock assembly, such that upward movement of the whipstock assembly causes the tapered lead surface to force the lug radially inward to move the lug past the locator sleeve.

35. The assembly as defined in claim 32, wherein the locator sleeve includes an orienting surface below the locator notch for rotating the lug into alignment with the locator notch.

36. The assembly as defined in claim 32, wherein the whipstock assembly further comprises:

a whipstock body including a curvilinear exterior surface radially opposite the whipstock face for engagement with an interior surface of the tubular;

an upper tapered surface fixed with respect to the whipstock face; and a lower tapered surface for sliding engagement with the upper tapered surface to force the curvilinear surface into engagement with the tubular.

37. The assembly as defined in claim 36, further comprising:

a connection mechanism for preventing sliding engagement of the lower tapered surface with respect to the upper tapered surface; and a release mechanism for releasing the connection mechanism.

38. The assembly as defined in claim 32, further comprising:

the whipstock assembly including a lug housing;

a lug being axially movable with respect to the lug housing;

a biasing member for biasing the lug in a radially outward position; and a stop on the lug housing for preventing radially outward movement of the lug until the lug moves axially from a deactivated position to a release position.

39. The assembly as defined in claim 32, further comprising:

a shear member for maintaining the lug axially in the deactivated position until the shear member is severed.

40. The assembly as defined in claim 32, further comprising:

a locator tool movable within the tubular for engagement with the locator notch to determine the azimuth of the locator notch; and the adjustment member adjusts the position of the lug relative to the whipstock face while the whipstock assembly is at the surface of the well.

41. A method of drilling a lateral from a borehole into a formation of interest with a drill bit, the method comprising:

securing an elongate tubular string within the borehole, the tubular string having a plurality of locators positioned at fixed locations along the tubular string, each whipstock locator including a locator sleeve having a sealed bore therethrough in fluid communication with the flow path in the tubular string;

adjusting the circumferential position of a lug relative to a whipstock face;

lowering a whipstock assembly with the lug thereon below a selected one of the plurality of locators; and temporarily interconnecting the lug within the respective locator and thereby secure the whipstock assembly within the tubular against longitudinal and rotational movement, such that the drill bit may engage the whipstock face to drill a window through the tubular.

42. The method as defined in claim 41, further comprising:

positioning a locator tool downhole for engagement with the locator to determine the azimuth of a notch in the locator extending partially through a wall in the tubular string.

43. The method as defined in claim 42, wherein the circumferential position of the lug relative to the whipstock face is adjusted while the whipstock assembly is at the surface and in response to determining the azimuth of the locator notch.

44. The method as defined in claim 41, further comprising:

biasing the lug in the radially outward position;

positioning a stop for engagement with the lug to prevent radially outward movement of the lug; and moving the lug into a release position such that the lug is moved out of engagement with the stop.

45. The method as defined in claim 41, further comprising:

providing an upper tapered surface on the whipstock assembly fixed with respect to the whipstock face;

providing a lower tapered surface on the whipstock assembly;

slidably engaging the upper tapered surface and the lower tapered surface to press a curvilinear exterior surface of the whipstock assembly radially opposite the whipstock face into engagement with the tubular.

46. The method as defined in claim 41, further comprising:

providing a stop surface on the lug substantially perpendicular to a central axis of the whipstock;

providing a support surface on the locator sleeve substantially perpendicular to a central axis of the tubular; and engaging the stop surface and the support surface to prevent both downward and rotational movement of the whipstock assembly with respect to the locator sleeve.

47. The method as defined in claim 41, further comprising:

providing a tapered lead surface on at least one of the locator sleeve and the lug, the tapered lead surface being inclined relative to a central axis of the whipstock assembly; and moving the whipstock assembly upward within the tubular to cause the lead surface to force the lug radially inward and release the lug from the whipstock locator.

48. The method as defined in claim 41, further comprising:

after drilling the lateral, raising the whipstock assembly to releasably interconnect the lug with another one of the plurality of locators above the drilled lateral; and thereafter rotating the drill bit while engaging the whipstock face to drill another window through another portion of the tubular.

* * * * *